US007418227B2

(12) United States Patent
Omata

(10) Patent No.: US 7,418,227 B2
(45) Date of Patent: Aug. 26, 2008

(54) IMAGE FORMING APPARATUS FOR HIGHER SPEED PRINTING

(75) Inventor: Yasukuni Omata, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 83 days.

(21) Appl. No.: 11/370,853

(22) Filed: Mar. 9, 2006

(65) Prior Publication Data

US 2006/0204290 A1 Sep. 14, 2006

(30) Foreign Application Priority Data

Mar. 9, 2005 (JP) ..... 2005-066363

(51) Int. Cl.
*G03G 15/16* (2006.01)
*G03G 15/00* (2006.01)
*G03G 15/20* (2006.01)

(52) U.S. Cl. ..... 399/309; 399/45; 399/322

(58) Field of Classification Search ..... 399/45, 399/68, 309, 322, 389, 400
See application file for complete search history.

(56) References Cited

U.S. PATENT DOCUMENTS

| | | | | |
|---|---|---|---|---|
| 6,574,448 | B2 | 6/2003 | Mochimaru et al. | |
| 6,584,295 | B2 | 6/2003 | Omata et al. | |
| 6,608,985 | B2 | 8/2003 | Mochimaru et al. | |
| 6,633,733 | B2 | 10/2003 | Mochimaru et al. | |
| 6,643,489 | B2 | 11/2003 | Omata et al. | |
| 6,728,505 | B2 | 4/2004 | Omata et al. | |
| 6,741,825 | B2 | 5/2004 | Omata et al. | |
| 6,801,742 | B1 | 10/2004 | Mochimaru et al. | |
| 6,898,398 | B2 | 5/2005 | Omata et al. | |
| 6,898,408 | B2 | 5/2005 | Omata et al. | |
| 6,941,094 | B2 | 9/2005 | Omata et al. | |
| 6,983,117 | B2 | 1/2006 | Sohmiya et al. | |
| 6,985,687 | B2 | 1/2006 | Mochimaru et al. | |
| 2002/0060804 | A1 | 5/2002 | Mochimaru et al. | |
| 2004/0131397 | A1 * | 7/2004 | Kikuchi | 399/309 |
| 2004/0131398 | A1 | 7/2004 | Omata et al. | |
| 2004/0190944 | A1 * | 9/2004 | Kita | 399/258 |
| 2004/0223793 | A1 | 11/2004 | Omata et al. | |
| 2005/0025538 | A1 | 2/2005 | Omata | |

FOREIGN PATENT DOCUMENTS

| | | |
|---|---|---|
| JP | 10-142869 | 5/1998 |
| JP | 2004-206074 | 7/2004 |

OTHER PUBLICATIONS

U.S. Appl. No. 10/769,844, filed Feb. 3, 2004, Omata et al.

* cited by examiner

*Primary Examiner*—Sandra L Brase
(74) *Attorney, Agent, or Firm*—Oblon, Spivak, McClelland, Maier & Neustadt, P.C.

(57) ABSTRACT

An image forming apparatus includes a first image carrying belt, a second image carrying belt, a first transfer unit, a second transfer unit, a fixing unit, and a controller. Each of the first and second image carrying belt carries a toner image on their respective surface. The first and second transfer unit transfer the toner image from the respective first and second image carrying belt to a first and second face of a recording medium, respectively. The fixing unit receives the recording medium directly from the second image carrying belt and fixes the toner image on the respective first and second face of the recording medium. The controller variably controls a transport speed of the second image carrying belt depending on types of the recording medium when the second image carrying belt transports the recording medium from the second transfer unit to the fixing unit.

23 Claims, 4 Drawing Sheets

IMAGE FORMING APPARATUS FOR HIGHER SPEED PRINTING

BACKGROUND OF THE INVENTION

1. Field of the Invention

The present disclosure generally relates to an image forming apparatus such as a copier, facsimile, and printer, and more particularly to an image forming apparatus, which can produce images on a recording medium with a one-path system.

2. Discussion of the Background

In general, an image forming apparatus can use methods such as a switch-back system and one-path system to produce images on both faces of a recording medium such as a transfer sheet.

In case of the switch-back system, the recording medium is passed through a transfer unit and then a fixing unit to record an image on one face of the recording medium, and then the recording medium is transported to a sheet inverting route to invert faces of the recording medium. Then, the recording medium is switch-backed to the transfer unit and the fixing unit to record an image on the other face of the recording medium.

In case of the one-path system, a double-side transfer mechanism transfers images to both faces of the recording medium and then the recording medium is passed through a fixing unit. Therefore, images can be recorded on both faces of the recording medium without switch-backing the recording medium.

Accordingly, the one-path system can avoid the following aspects associated with the switch-back system; a cost increase due to providing a switch-back mechanism; a longer time for image forming due to the switch-back process; a sheet jamming which might occur by switch-backing the recording medium curled by heating of a fixing unit, as examples.

However, in the one-path system, a disturbance may occur on images when transporting a recording medium from the double-side transfer mechanism to the fixing unit.

In general, a sheet transporting unit is provided between the double-side transfer mechanism and fixing unit in an image forming apparatus employing the one-path system to transport the recording medium having unfixed images on its both faces. When such a recording medium is transported from the double-side transfer mechanism to the fixing unit in the one-path system, the recording medium may be scratched by components of the sheet transporting unit because one face of the recording medium having un-fixed toner image contacts such component. With such a scratching, the un-fixed toner image on the recording medium may be disturbed.

If a toner image is transferred only to one face of the recording medium (e.g., transfer sheet), a disturbance of an un-fixed toner image can be prevented by contacting a face of the recording medium having no toner image to the component of the sheet transporting unit. Such a configuration can be designed by modifying a design layout in an image forming apparatus.

However, if toner images are transferred to both faces of the recording medium (e.g., transfer sheet), one face of the recording medium having toner image contacts the component of the sheet transporting unit, thereby a disturbance on images may occur when transporting the recording medium from the double-side transfer mechanism to the fixing unit.

In one related art, a spur, having a plurality of projections on its peripheral circumference, is provided between a double-side transfer mechanism and a fixing unit in an image forming apparatus, wherein the double-side transfer mechanism can transfer toner images to both faces a recording medium (e.g., transfer sheet), and the spur can be rotated by a driving unit.

With such a configuration, the recording medium (e.g., transfer sheet) can be guided (i.e., transported) from the double-side transfer mechanism to the fixing unit in the image forming apparatus.

The spur can support the recording medium by projections from the underside of the recording medium. With a rotation of the spur, the recording medium can be guided (i.e., transported) from the double-side transfer mechanism to the fixing unit with being supported by the spur from the underside face of the recording medium. However, the spur has projections that stick the recording medium. Thereby, un-fixed toner images on the recording medium may be disturbed, particularly if the projections of the spur have a sharp profile.

In another related image forming apparatus, a recording medium is transported from a double-side transfer mechanism to a fixing unit by interposing a transport belt between the double-side transfer mechanism and the fixing unit, wherein the double-side transfer mechanism transfers toner images to both faces of the recording medium.

Such a transport belt can be an endless type belt, which is extended by a plurality of rollers. The transport belt receives the recording medium from an intermediate transfer belt of the double-side transfer mechanism, and guides (i.e., transports) the recording medium toward the fixing unit. Specifically, a front edge of the recording medium is guided (i.e., transported) to the fixing unit by the transport belt.

In such an image forming apparatus, the transport belt and the intermediate transfer belt of the double-side transfer mechanism can be driven with a same speed, thereby the recording medium can be guided (i.e., transported) from the intermediate transfer belt to the transport belt with a same speed, by which scratching of image on the recording medium can be suppressed when the recording medium is transported from the intermediate transfer belt to the transport belt.

With such a configuration, disturbance of un-fixed toner image on the recording medium can be suppressed.

However, even in such an image forming apparatus, a counteraction may occur between the intermediate transfer belt and the transport belt when the recording medium is received by the transport belt from the intermediate transfer belt.

Although the intermediate transfer belt and transport belt can be driven at a same speed, the intermediate transfer belt and transport belt have a gap therebetween, and thereby the recording medium may receive some counteraction force when the transport belt receives the recording medium from the intermediate transfer belt.

With such counteraction force at the gap, the recording medium may be scratched by the transport belt, thereby disturbance may occur on un-fixed toner images on the recording medium.

In case of an image forming apparatus for printing a color image with higher speed on both faces of the recording medium, such disturbance of un-fixed toner images on the recording medium may occur to a greater degree.

In such an image forming apparatus for printing color image with higher speed, two tandem configurations are provided for a double-side transfer mechanism to produce an image on both faces of a recording medium. Specifically, one tandem configuration includes a first intermediate transfer belt and a first group of photosensitive members (e.g., four photosensitive members) to form toner images on the first intermediate transfer belt and then on one face of the recording medium. The other tandem configuration includes a second intermediate transfer belt and a second group of photosensitive members (e.g., four photosensitive members) to form toner images on the second intermediate transfer belt and then on another face of the recording medium.

Four photosensitive members in each of the first and second group of photosensitive members are used to form yellow (Y), magenta (M), cyan (C), and black (K) toner images. Such four photosensitive members serving as image carrying members are arranged in a parallel manner (i.e., tandem manner). Such a configuration can be used to produce a toner image on each face of the recording medium.

The Y, M, C, and K toner image formed on the photosensitive members of the first group are super-imposingly transferred to the first intermediate transfer belt, and then transferred to one face of the recording medium to produce a full-color toner image on one face of the recording medium. Similarly, the Y, M, C, and K toner image formed on the photosensitive members of the second group are super-imposingly transferred to the second intermediate transfer belt, and then transferred to the other face of the recording medium to produce a full-color toner image on the other face of the recording medium.

In such an image forming apparatus used for printing color image with higher speed, a full-color toner image can be transferred to both faces the recording medium while transporting the recording medium with higher speed.

However, because of such higher speed for transporting the recording medium, the recording medium may receive a relatively greater counteraction when the recording medium is transported from the intermediate transfer belt to the transport belt.

With such counteraction, the recording medium may be scratched by the transport belt, or sheet jamming may occur between the intermediate transfer belt and the transport belt.

SUMMARY OF THE INVENTION

The present disclosure relates to an image forming apparatus which includes a first image carrying belt, a second image carrying belt, a first transfer unit, a second transfer unit, a fixing unit, and a controller. The first image carrying belt carries a first toner image on its surface and the second image carrying belt carries a second toner image on its surface. The first transfer unit transfers the first toner image from the first image carrying belt to a first face of a recording medium. The second transfer unit transfers the second toner image from the second image carrying belt to a second face of the recording medium. The fixing unit receives the recording medium directly from the second image carrying belt and fixes the first and second toner image on the respective first and second faces of the recording medium. The controller variably controls a transport speed of the second image carrying belt depending on types of the recording medium when the second image carrying belt transports the recording medium from the second transfer unit to the fixing unit.

The present disclosure also relates to an image forming apparatus which includes toner having an average circularity of from 0.90 to 0.99, preferably from 0.93 to 0.97, a shape factor SF-1 of from 120 to 180 and a shape factor SF-2 of from 120 to 190, and a ratio Dv/Dn of 1.05 to 1.30, preferably from 1.10 to 1.25. Dv/Dn is a ratio of the volume average particle diameter Dv to the number average particle diameter Dn.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF PREFERRED EMBODIMENTS

Figure 1:
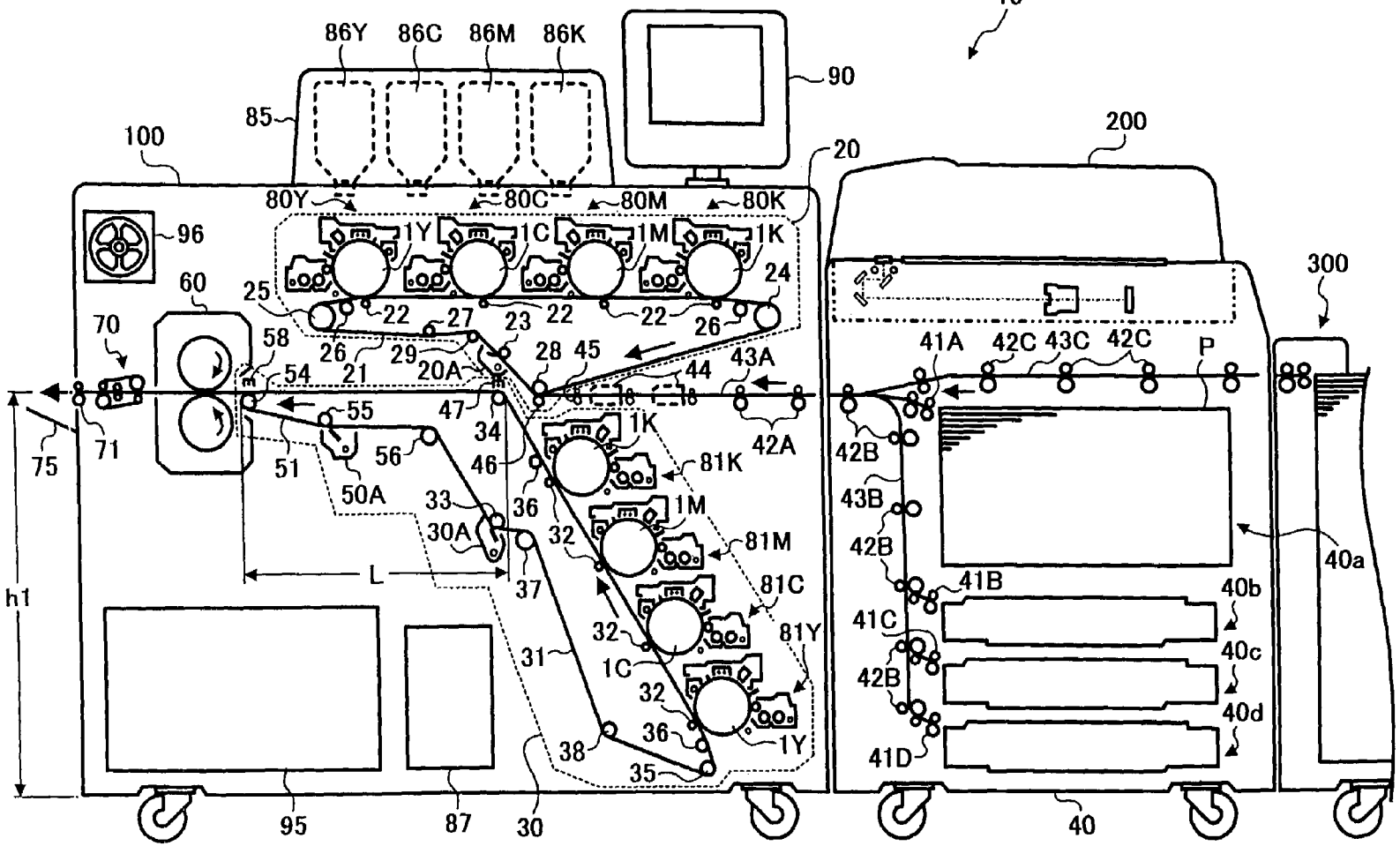
FIG. 1 is a schematic configuration of an image forming apparatus according to an embodiment of the present invention, in which a second intermediate transfer belt directly transports a transfer sheet to a fixing unit.

In describing example embodiments shown in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to a non-limiting embodiment of the present invention is described with reference to FIG. 1.

FIG. 1 is a schematic configuration of an image forming apparatus 10 according to a non-limiting embodiment of the present invention, wherein the image forming apparatus 10 can be used as a color image forming apparatus using electro photography, for example.

The image forming apparatus 10 includes a printing unit 100, an operation/display unit 90, a sheet feed unit 40, an automatic document feeder 200, and an annex sheet feed unit 300 as illustrated in FIG. 1.

The printing unit 100 includes a first image forming section 20, a second image forming section 30, a sheet feed route 43A, and a controller 95 as illustrated in FIG. 1.

The first image forming section 20 is disposed over the sheet feed route 43A, and the second image forming section 30 is disposed under the sheet feed route 43A.

The first image forming section 20 includes a first intermediate transfer belt 21 configured to travel in a direction shown by an arrow in FIG. 1. The first intermediate transfer belt 21 includes an endless type belt as illustrated in FIG. 1.

The second image forming section 30 includes a second intermediate transfer belt 31 configured to travel in a direction shown by an arrow in FIG. 1. The second intermediate transfer belt 31 includes an endless type belt as illustrated in FIG. 1.

As illustrated in FIG. 1, first process units 80Y, 80M, 80C, and 80K are disposed above the first intermediate transfer belt 21, wherein the first process units 80Y, 80M, 80C, and 80K are used for toner image forming.

As also illustrated in FIG. 1, second process units 81Y, 81M, 81C, and 81K are disposed to a side portion of the second intermediate transfer belt 31, wherein the second process units 81Y, 81M, 81C, and 81K are used for toner image forming.

Hereinafter, reference characters "Y, M, C, and K" indicate colors of "yellow, magenta, cyan, and black," respectively.

Each of the process units (i.e., 80Y, 80M, 80C, 80K, 81Y, 81M, 81C, 81K) includes a photosensitive member (i.e., 1Y, 1M, 1C, 1K) serving as image carrying member.

The first process units 80Y, 80M, 80C, and 80K include the photosensitive members 1Y, 1M, 1C, and 1K, respectively, wherein the photosensitive members 1Y, 1M, 1C, and 1K are arranged with an equal interval, and can be contacted to an outer surface of the first intermediate transfer belt 21 when conducting an image forming.

Hereinafter, such an outer surface of the first intermediate transfer belt 21 is referred to as a first image receiving belt-surface.

The second process units 81Y, 81M, 81C, and 81K include the photosensitive members 1Y, 1M, 1C, and 1K, respectively, wherein the photosensitive members 1Y, 1M, 1C, and 1K are arranged with an equal interval, and can be contacted to an outer surface of the second intermediate transfer belt 31 when conducting an image forming.

Hereinafter, such an outer surface of the second intermediate transfer belt 31 is referred as a second image receiving belt-surface.

As illustrated in FIG. 1, the first intermediate transfer belt 21 is extended by a plurality of rollers in a substantially horizontal direction, thereby the first image receiving belt-surface substantially extends in a horizontal direction as illustrated in FIG. 1. Accordingly, the first intermediate transfer belt 21 occupies a space in the printing unit 100 in a horizontal direction.

The first process units 80Y, 80M, 80C, and 80K are arranged in a tandem manner above the first image receiving belt-surface of the first intermediate transfer belt 21 as illustrated in FIG. 1.

The second intermediate transfer belt 31 is extended by a plurality of rollers, and is extended in a shape of character "V" as a whole, wherein the extended second intermediate transfer belt 31 has a shape resembled to an inverted "V" as illustrated in FIG. 1. As illustrated in FIG. 1, an upper left portion of the second intermediate transfer belt 31 extends in a horizontal direction, and a right side portion of the second intermediate transfer belt 31 extends in a downward direction.

The second process units 81Y, 81M, 81C, and 81K are arranged in a tandem manner along the right side portion (i.e., second image receiving belt-surface) of the second intermediate transfer belt 31, thereby the second process units 81Y, 81M, 81C, and 81K are arranged in a step-wise manner in a substantially vertical direction as illustrated in FIG. 1.

Figure 2:
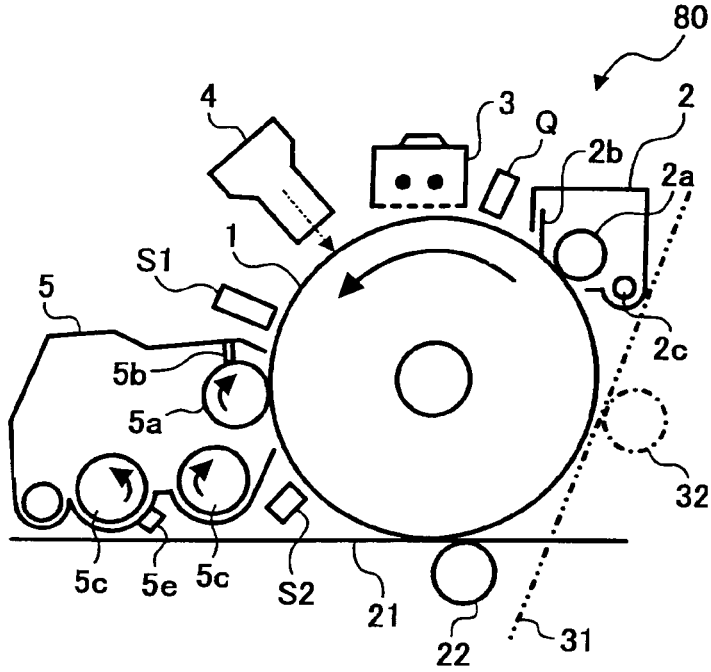
FIG. 2 is a schematic expanded view of a first process unit in a printing unit of an image forming apparatus in FIG. 1.

FIG. 2 is a schematic expanded view of a process unit of the first process units 80Y, 80M, 80C, and 80K in the printing unit 100 of the image forming apparatus 10. Because the first process units 80Y, 80M, 80C, and 80K take a similar configuration with respect to one anther except color type of toner, reference characters "Y, M, C, and K" are omitted from the drawing in FIG. 2.

As illustrated in FIG. 2, the photosensitive member 1 is driven in a counter-clockwise direction by a drive unit (not shown) when the printing unit 100 is operated for image forming.

As illustrated in FIG. 2, the photosensitive member 1 is surrounded by a scorotron charger 3, an optical writing unit 4, a developing unit 5, a cleaning unit 2, a de-charging unit Q, an electric potential sensor S1, and an image sensor S2, for example.

The photosensitive member 1 can be formed in a drum shape. For example, the photosensitive member 1 can be made of an aluminum cylinder having a diameter of 30 mm to 120 mm, and a photoconductivity material such as organic photoconductor (OPC) and amorphous silicon (a-Si) is coated on the cylinder.

Although not shown, the photosensitive member 1 can also be formed in a belt shape.

As illustrated in FIG. 2, the cleaning unit 2 includes a cleaning brush 2*a*, a cleaning blade 2*b*, and a collector 2*c*. The cleaning unit 2 removes and collects toners remaining on the photosensitive member 1 after a toner image is transferred to the first intermediate transfer belt 21 from the photosensitive member 1 at a primary transfer nip (to be described later).

The scorotron charger 3 uniformly charges a surface of the photosensitive member 1 to a negative potential, for example. Instead of the scorotron charger 3, a corotron charger can be used to uniformly charge a surface of the photosensitive member 1. Furthermore, instead of the scorotron charger 3, a charge biasing member (not shown) having applied thereto a charge bias can be contacted to the surface of the photosensitive member 1, for example.

The optical writing unit 4 scans the charged surface of the photosensitive member 1 with a light beam, generated based on image data for each color, to form an electrostatic latent image on the surface of the photosensitive member 1. The optical writing unit 4 includes a LED (light emitting diode) array and a focusing element, for example. The optical writing unit 4 can also include a laser type unit, which includes a laser beam source, a polygon mirror, and other components to generate a modulated laser beam based on image data.

The developing unit 5 includes a developing roller 5*a*, a blade 5*b*, transport screws 5*c*, and a toner concentration sensor 5*e*.

The developing unit 5 also includes a two-component developer having toners and magnetic carriers to develop the electrostatic latent image formed on the photosensitive member 1. The two-component developer is agitated and transported in a predetermined direction by two transport screws 5*c* in the developing unit 5. Each of the transport screws 5*c* transports the developer in opposite directions to each other in the developing unit 5. For example, if the transport screw 5*c* in a left side in FIG. 2 transports the developer in one direction, the transport screw 5*c* in a right side in FIG. 2 transports the developer in another direction opposite to that of the transport screw 5*c* in a left side in FIG. 2. The two-component developer, agitated and transported by the transport screw 5*c* in a left side in FIG. 2, is then transported to the transport screw 5*c* in a right side in FIG. 2. During agitation and transportation of the two-component developer by the transport screw 5*c* in a right side in FIG. 2, some two-component developer is carried onto the developing roller 5*a*. The two-component developer not carried onto the developing roller 5*a* is transported to the transport screw 5*c* in a left side in FIG. 2. As such, the two-component developer is re-circulated in the developing unit 5.

Furthermore, the developing unit 5 can include one-component developer having toners without magnetic carriers.

The developing roller 5*a* includes a sleeve and a magnet roller. The sleeve can be made of non-magnetic material, such as stainless steel or aluminum, and is driven by a drive unit (not shown) in a clockwise direction as shown in FIG. 2.

Although the magnet roller is encased in the sleeve, the magnet roller does not rotate with the sleeve. The magnet roller includes a plurality of magnets provided on a circumference of the magnet roller.

The two-component developer transported by the transport screw 5*c* in a right side of FIG. 2 is attracted by magnetic field of the magnet roller, and carried onto the sleeve. Then, the two-component developer on the sleeve comes to a regulating position defined by the blade 5*b* before being transported to a developing area facing the photosensitive member 1. The blade 5*b* faces the sleeve with a predetermined gap therebetween by positioning an edge of the blade 5*b* at a predetermined position from the sleeve.

When the two-component developer on the sleeve passes the edge of the blade 5*b*, the blade 5*b* regulates a layer thickness of the two-component developer on the sleeve to a predetermined level. Then, the two-component developer having the regulated layer thickness is transported to the developing area facing the photosensitive member 1 with a rotation of the sleeve.

In the developing area, the electrostatic latent image formed on the photosensitive member 1 is developed as a toner image with an adhesion of toners of the two-component developer. With such a process, each toner image of Y, M, C, and K is formed on the photosensitive member 1.

The toner includes a spherical toner and non-spherical toner, which can be made by a known method. The toner has a volume average particle diameter of 20 μm or less, and preferably from 4 μm to 10 μm, for example.

The magnetic carrier can be made by a known method. The magnetic carrier preferably has a volume average particle diameter of 25 μm to 60 μm, for example.

The two-component developer which released the toner at the developing area returns to the developing unit 5 with a rotation of the sleeve.

With an effect of the magnetic field caused by magnets on the magnet roller, the two-component developer is dropped from the sleeve and returned to the transport screw 5*c* in a right side of FIG. 2, and then moved to the transport screw 5*c* in a left side of FIG. 2.

As illustrated in FIG. 2, the toner concentration sensor 5*e* is provided under the transport screw 5*c* in a left side of FIG. 2 to detect magnetic permeability of the two-component developer transported by the transport screw 5*c* in a left side of FIG. 2. The magnetic permeability of the two-component developer correlates to toner concentration, and thereby the toner concentration sensor 5*e* detects the toner concentration in the developing unit 5.

If the controller 95 judges that the toner concentration in the two-component developer is below a predetermined threshold value based on an output signal of the toner concentration sensor 5*e*, one of eight toner supply units (not shown) is activated for a predetermined time to supply fresh toners to the developing unit 5. Each of the eight toner supply units (not shown) corresponds to the developing unit 5 in the first process units 80Y, 80M, 80C, and 80K or developing unit 5 in the second process units 81Y, 81M, 81C, and 81K. Each of the eight toner supply units (not shown) is connected to one of corresponding toner bottles 86Y, 86M, 86C, and 86K, wherein the toner bottles 86Y, 86M, 86C, and 86K are detachably provided in a bottle compartment 85 placed on a top of the printing unit 100 as illustrated in FIG. 1.

Each toner of Y, M, C, and K, supplied to the corresponding developing unit 5 from the toner bottles 86Y, 86M, 86C, and 86K is refilled onto the transport screw 5*c* in a left side of FIG. 2. With such a process, toners can be refilled to the two-component developer in the developing unit 5, and thereby a toner concentration in the developing unit 5 can be maintained at a predetermined level.

As for the toner supply unit (not shown), a publicly-known mohno-pump is preferably used to suck toners from the toner bottles (i.e, 86Y, 86M, 86C, and 86K) and to transport toners to the developing unit 5.

Because such a configuration has less restriction on designing a place to set the toner bottles (i.e, 86Y, 86M, 86C, and 86K), it is preferable from a viewpoint of space allocation in the printing unit 100. Furthermore, because such a configuration can supply toners to the developing unit 5 as required, the developing unit 5 does not require a larger space for storing toners. Thereby, the developing unit 5 can be miniaturized.

Figure 3:
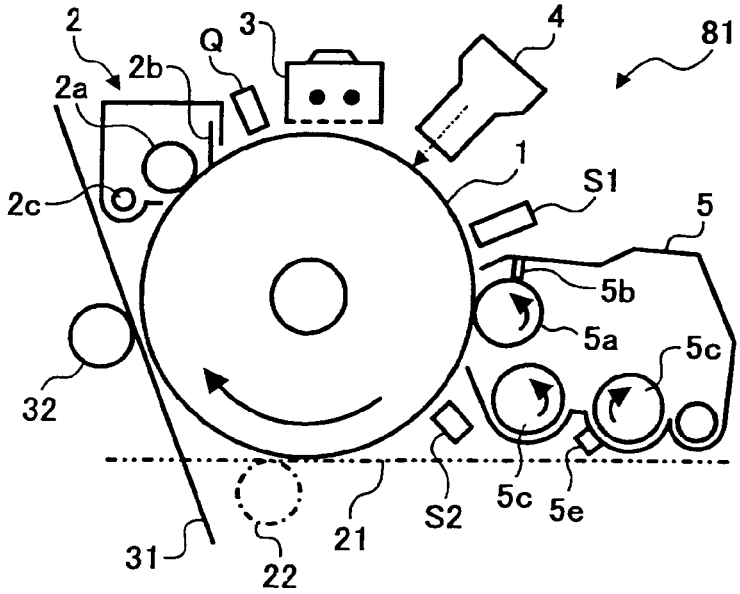
FIG. 3 is a schematic expanded view of a second process unit in a printing unit of an image forming apparatus in FIG. 1.

FIG. 3 is a schematic expanded view of a process unit of second process units 81Y, 81M, 81C, and 81K in the printing unit 100 of the image forming apparatus 10. The second process units 81Y, 81M, 81C, and 81K take a similar configuration with respect to one anther except for the color type of toner. Furthermore, the second process units 81Y, 81M, 81C, and 81K and the first process units 80Y, 80M, 80C, and 80K take a similar configuration with respect to one anther except for a rotation direction of the photosensitive member 1, wherein the photosensitive member 1 in the second process units 81Y, 81M, 81C, and 81K rotate in an opposite direction compared to the photosensitive member 1 in the first process units 80Y, 80M, 80C, and 80K.

The first process units 80Y, 80M, 80C, and 80K and the second process units 81Y, 81M, 81C, and 81K have a symmetrical configuration with each other as illustrated in FIGS. 2 and 3. Such a symmetrical configuration has preferable aspects as indicated below.

For example, such a symmetrical configuration is preferable by considering a design layout for connecting the process unit 80 and 81 with other units in the printing unit 100 such as a drive unit, electrical unit, toner supply unit, and toner ejection unit. Furthermore, the first process units 80Y, 80M, 80C, and 80K and the second process units 81Y, 81M, 81C, and 81K can be made as interchangeable units because of such a symmetrical configuration. Accordingly, the first process units 80Y, 80M, 80C, and 80K and the second process units 81Y, 81M, 81C, and 81K can use common parts for the developing unit 5, cleaning unit 2 and other units, and thereby unique parts are not required for each of the first process units 80Y, 80M, 80C, and 80K and the second process units 81Y, 81M, 81C, and 81K. Therefore, a manufacturer can streamline parts management and manufacturing works, by which an overall manufacturing cost of an image forming apparatus can be reduced.

As illustrated in FIG. 1, the printing unit 100 includes the first image forming section 20 and the second image forming section 30.

In the first image forming section 20, the first intermediate transfer belt 21 is extended by a plurality of rollers 22, 23, 24, 25, 26, 27, 28, and 29.

The first intermediate transfer belt 21 can contact the photosensitive members 1Y, 1M, 1C, and 1K of the respective first process units 80Y, 80M, 80C, and 80K. Such a contact point of the first intermediate transfer belt 21 and the photosensitive members 1Y, 1M, 1C, and 1K is defined as a primary transfer nip formed between the first intermediate transfer belt 21 and the photosensitive members 1Y, 1M, 1C, and 1K. At such a primary transfer nip, Y, M, C, and K toner images on the respective photosensitive members 1Y, 1M, 1C, and 1K are super-imposingly transferred to the first intermediate transfer belt 21.

The first intermediate transfer belt 21 of endless type belt travels in a clockwise direction as shown by an arrow in FIG. 1. At each primary transfer nip, a primary transfer roller 22 and the photosensitive members 1Y, 1M, 1C, and 1K sandwich the first intermediate transfer belt 21, wherein the primary transfer roller 22 is applied with a primary transfer bias voltage by a power source (not shown). With an effect of the primary transfer bias voltage and nip pressure, Y, M, C, and K toner images on the respective photosensitive members 1Y, 1M, 1C, and 1K are super-imposingly transferred to the first intermediate transfer belt 21 at each primary transfer nip.

The first intermediate transfer belt 21 and relating parts are integrated in the first image forming section 20, and thereby the first image forming section 20 is detachable from the printing unit 100 as one unit.

In the second image forming section 30, the second intermediate transfer belt 31 is extended by a plurality of rollers 32, 33, 34, 35, 36, 37, 38, 54, 55, and 56.

The second intermediate transfer belt 31 can contact the photosensitive members 1Y, 1M, 1C, and 1K of the respective second process units 81Y, 81M, 81C, and 81K. Such a contact point of the second intermediate transfer belt 31 and the photosensitive members 1Y, 1M, 1C, and 1K is defined as a primary transfer nip formed between the second intermediate transfer belt 31 and the photosensitive members 1Y, 1M, 1C, and 1K. At such a primary transfer nip, Y, M, C, and K toner images on the respective photosensitive members 1Y, 1M, 1C, and 1K are super-imposingly transferred to the second intermediate transfer belt 31.

The second intermediate transfer belt 31 of endless type belt travels in a counter-clockwise direction as shown by an arrow in FIG. 1. At each primary transfer nip, a primary transfer roller 32 and the photosensitive members 1Y, 1M, 1C, and 1K sandwich the second intermediate transfer belt 31, wherein the primary transfer roller 32 is applied with a primary transfer bias voltage by a power source (not shown). With an effect of the primary transfer bias voltage and nip pressure, Y, M, C, and K toner images on the respective photosensitive members 1Y, 1M, 1C, and 1K are super-imposingly transferred to the second intermediate transfer belt 31 at each primary transfer nip.

The second intermediate transfer belt 31 and relating parts are integrated in the second image forming section 30, and thereby the second image forming section 30 is detachable from the printing unit 100 as one unit.

Each of the first intermediate transfer belt 21 and second intermediate transfer belt 31 includes a base layer made of material such as resin film and rubber having a thickness of 50 μm to 600 μm, for example.

Such intermediate transfer belts (i.e., first intermediate transfer belt 21 and second intermediate transfer belt 31) have an electric resistance value which enables a transfer of a toner image from the photosensitive member 1 to the surface of the intermediate transfer belt electro-statistically with an effect of a primary transfer bias voltage applied by the primary transfer roller 22 or 32.

For example, such intermediate transfer belts can be made by dispersing carbons in polyamide and adjusting a volume electric resistance value in a range of $10^6$ to $10^{12}$ Ω·cm.

Furthermore, each of the first intermediate transfer belt 21 and the second intermediate transfer belt 31 includes a belt-aligning rib at one lateral side of the belt or both lateral sides of the belt, wherein the belt-aligning rib is used for stabilizing a traveling direction of the belt.

The primary rollers 22 and 32 include the following structure, as a non-limiting example.

Specifically, the primary rollers 22 and 32 include a core and an electro-conductive layer coated on the core. The core is made of a metal and the electro-conductive layer includes rubber material. The core is applied with a primary bias voltage from a power source (not shown). In an example embodiment, the electro-conductive layer can be made by dispersing carbons in urethane rubber and adjusting a volume electric resistance value to approximately $10^5$ Ω·cm.

The printing unit 100 can also produce a monochrome image by using only black toner. In a case of producing a monochrome image, the process units 80Y, 80M, and 80C in the first image forming section 20 are not used.

The printing unit 100 includes a mechanism (not shown) to maintain a non-contact condition between the process units 80Y, 80M, and 80C and the first intermediate transfer belt 21 when producing a monochrome image and stopping an operation of the process units 80Y, 80M, and 80C. For example, such a mechanism includes an internal frame (not shown), which can move in a pivotable manner while supporting the roller 26 and the primary roller 22. By such pivoting of the internal frame, the first intermediate transfer belt 21 is disengaged from the photosensitive members 1Y, 1M, and 1C, and is contacted only to the photosensitive member 1K. Then, the image forming apparatus 10 can produce a monochrome image using black toner. Such a mechanism is preferable for prolonging a lifetime of the photosensitive members.

Similarly, the second image forming section 30 also includes such a mechanism to maintain a non-contact condition of the process units 81Y, 81M, and 81C and the second intermediate transfer belt 31 when the image forming apparatus 10 produces a monochrome image.

As illustrated in FIG. 1, a secondary transfer roller 46 is provided near a support roller 28 and an outer face of the first intermediate transfer belt 21. The secondary transfer roller 46 and the support roller 28 sandwich the first intermediate transfer belt 21 therebetween to form a secondary transfer nip.

Specifically, the secondary transfer roller 46 includes a core and an electro-conductive layer coated on the core. The core is made of a metal and the electro-conductive layer includes rubber material. The core is applied with a secondary bias voltage from a power source (not shown). In an example embodiment, the electro-conductive layer can be made by dispersing carbons in urethane rubber and adjusting a volume electric resistance value to approximately $10^7$ Ω·cm.

As illustrated in FIG. 1, a pair of registration rollers 45 are provided in a rightward direction of the secondary transfer nip, defined by the secondary transfer roller 46 and the support roller 28. The pair of registration rollers 45 sandwich a transfer sheet P transported from the sheet feed unit 40 (to be described later), and stops the rotation of the registration rollers 45 temporally. Then, the pair of registration rollers 45 feed the transfer sheet P to the secondary transfer nip, defined by the secondary transfer roller 46 and the support roller 28, by synchronizing a feed timing with a traveling speed of the first intermediate transfer belt 21 having a four-color toner image thereon.

The transfer sheet P has a first and second face, which are opposite sides of the transfer sheet P. In FIG. 1, the first face of the transfer sheet P faces upward and receives the four-color toner image from the first intermediate transfer belt 21 at the secondary transfer nip, defined by the secondary transfer roller 46 and the support roller 28.

At such a secondary transfer nip, the secondary transfer roller 46 applies a positive electric charge as a secondary transfer bias voltage, which is opposite to the negative charged toner. With an effect of the secondary transfer bias voltage and nip pressure, the four-color toner image is transferred from the first intermediate transfer belt 21 to the first face of the transfer sheet P, and then the transfer sheet P passes through the secondary transfer nip, defined by the secondary transfer roller 46 and the support roller 28.

As illustrated in FIG. 1, a cleaning unit 20A is provided at a position which faces the roller 23 by sandwiching the first intermediate transfer belt 21 between the cleaning unit 20A and the roller 23. The cleaning unit 20A removes foreign objects such as paper powder and toners remaining on the first intermediate transfer belt 21 after transferring a toner image to the transfer sheet P at the secondary transfer nip, defined by the secondary transfer roller 46 and support roller 28.

The transfer sheet P having passed through the secondary transfer nip leaves the first image forming section 20, and moves onto the second intermediate transfer belt 31 in the second image forming section 30. As illustrated in FIG. 1, the second intermediate transfer belt 31 includes a horizontally extended portion, and such horizontally extended portion of the second intermediate transfer belt 31 receives the transfer sheet P.

As illustrated in FIG. 1, a transfer charger 47 is provided over the horizontally extended portion of the second intermediate transfer belt 31 with a predetermined gap therebetween.

As illustrated in FIG. 1, the transfer charger 47 and the second intermediate transfer belt 31 define a secondary transfer nip, which is used for transferring a four-color toner image from the second intermediate transfer belt 31 to the second face of the transfer sheet P. As above-mentioned, the second face of the transfer sheet P is on an opposite side of the first face of the transfer sheet P and faces downward in FIG. 1. The transfer charger 47 includes a discharge electrode (e.g., tungsten and gold thin wire) and a casing for holding the discharge electrode, wherein the discharge electrode is applied with a secondary transfer voltage from a power source (not shown).

When the transfer sheet P passes through the secondary transfer nip, defined by the transfer charger 47 and the second intermediate transfer belt 31, the transfer sheet P is applied with an electric charge from the transfer charger 47 to transfer the four-color toner image from the second intermediate transfer belt 31 to the second face of the transfer sheet P. The transfer charger 47 applies a positive electric charge as secondary transfer bias voltage, which is opposite to the negative charged toner, at the secondary transfer nip, defined by the transfer charger 47.

The transfer charger 47 does not contact the surface of the transfer sheet P. Specifically, the transfer charger 47 does not contact the first face of the transfer sheet P. If the transfer charger 47 contacts the transfer sheet P, the four-color toner image transferred on the first face of the transfer sheet P may be disturbed by the transfer charger 47.

Accordingly, the transfer charger 47 is provided above the second intermediate transfer belt 31 by setting a predetermined gap between the second intermediate transfer belt 31 and the transfer charger 47.

As illustrated in FIG. 1, the sheet feed unit 40 is provided next to the printing unit 100. The sheet feed unit 40 stores recording medium such as transfer sheets and supplies recording medium to the printing unit 100.

As illustrated in FIG. 1, the sheet feed unit 40 includes sheet feed trays 40*a*, 40*b*, 40*c*, and 40*d*, for example. The sheet feed tray 40*a* can store a large capacity of transfer sheets compared to the other sheet feed trays 40*b*, 40*c*, and 40*d*, for example. Each of the sheet feed trays 40*a*, 40*b*, 40*c*, and 40*d* is configured to be withdrawable from the sheet feed unit 40. The sheet feed trays 40*a*, 40*b*, 40*c*, and 40*d* can store different types of transfer sheets therein. An upper most transfer sheet in the sheet feed trays 40*a*, 40*b*, 40*c*, and 40*d* can be fed to a sheet feed route 43B by corresponding feed devices 41A, 41B, 41C, and 41D, and then transported to the sheet feed route 43A by a pair of transport rollers 42B.

If the transfer sheet is too thick, such a transfer sheet cannot be fed to the sheet feed route 43A from the sheet feed trays 40*b*, 40*c*, and 40*d* because such a transfer sheet cannot bend at the transport rollers 42B provided for the sheet feed trays 40*b*, 40*c*, and 40*d* because of the thickness of the transfer sheet. In such a case, the thicker transfer sheets are stacked in the sheet feed tray 40*a* so that the thicker transfer sheet can be fed to the sheet feed route 43A. The thicker transfer sheet can be fed to the sheet feed route 43A with such a method because a height of the upper most transfer sheet in the sheet feed trays 40*a* can be set to a height substantially similar to a height "h1" of the sheet feed route 43A as illustrated in FIG. 1.

As illustrated in FIG. 1, the above-mentioned pair of registration rollers 45 is provided in the sheet feed route 43A to feed the transfer sheet P with a predetermined timing to the above-mentioned secondary transfer nips, defined by the secondary transfer roller 46 and the transfer charger 47.

Furthermore, a cross-direction position corrector 44 is provided in the sheet feed route 43A to correct an orientation of a transfer sheet with respect to a transport direction of the sheet feed route 43A. Specifically, the cross-direction position corrector 44 corrects a sheet direction so that a cross-direction of the transfer sheet, which is perpendicular to the transport direction in the sheet feed route 43A, does not deviate from a predetermined transport direction. The cross-direction position corrector 44 includes a reference guide in lateral side of the sheet feed route 43A and rollers (not shown), for example. The cross-direction position corrector 44 can push a lateral side of the transfer sheet with the reference guide to align the transfer sheet in a predetermined transport direction. The reference guide can be selectively set to a predetermined position according to a size of the transfer sheet.

The cross-direction position corrector 44 can also include a jogger type configuration. In a case of a jogger type, both lateral sides of the transfer sheet are pushed from both lateral directions of the transfer sheet (i.e., from right and left direction) with respect to the transport direction of the transfer sheet for a plurality of times in a short period of time to align the transfer sheet in a predetermined transport direction.

The transfer sheet P is transported to the secondary transfer nip, defined by the roller 28 and the secondary transfer roller 46, from the pair of registration rollers 45.

Then, the transfer sheet P is transported to the secondary transfer nip, defined by the second intermediate transfer belt 31 and the transfer charger 47.

Furthermore, the annex sheet feed unit 300 can be provided next to the sheet feed unit 40 to feed transfer sheets to the printing unit 100 through a sheet feed route 43C having a plurality of pair of transport rollers 42C. The annex sheet feed unit 300 can include a configuration similar to the sheet feed unit 40. With providing the annex sheet feed unit 300, the image forming apparatus 10 can conduct a higher volume of printing.

As for the sheet feed tray 40*a* of the sheet feed unit 40, a height of an upper most transfer sheet in the sheet feed tray 40*a* is substantially similar to the height "h1" of the sheet feed route 43A as illustrated in FIG. 1, and thereby the transfer sheet P can be fed from the sheet feed tray 40*a* to the sheet feed route 43A in a substantially horizontal direction without bending the transfer sheet P. With such a configuration, a transfer sheet having a greater thickness or higher stiffness can be fed from the sheet feed tray 40*a* to the sheet feed route 43A smoothly.

Furthermore, the sheet feed tray 40*a* preferably includes a vacuum mechanism (not shown) so that various types of transfer sheets can be fed from the sheet feed tray 40*a*.

Although not shown, a sensor can be provided in the sheet feed routes 43A, 43B, and 43C to detect types of transfer sheet, and such detected information can be used to trigger signals for image forming operation.

As illustrated in FIG. 1, a fixing unit 60 is provided next to the second image forming section 30. The fixing unit 60 includes heat rollers 61 and 62. Although not shown, the fixing unit 60 can also include a belt type unit and induction heating type unit, for example. In case of the belt type, a heated belt travels in one direction to fix a toner image on a transfer sheet. To realize a same image quality (e.g., coloring and glossiness) on both faces (i.e., first and second faces) of the transfer sheet P, the heat roller 61 and 62 are made of substantially similar material and have a substantially similar hardness and surface properties.

Furthermore, the controller 95 can change fixing conditions depending on an image forming mode such as full-color mode/monochrome mode, one-face image forming mode/both-face image forming mode, or depending on types of transfer sheets to be used for printing.

After fixing the toner image on the transfer sheet P, the transfer sheet P is fed to a cooling unit 70 provided next to the fixing unit 60 as illustrated in FIG. 1. The cooling unit 70 cools the transfer sheet to completely fix a toner image on the transfer sheet P with a shorter period of time. The cooling unit 70 can employ heat-pipe rollers to facilitate heat-radiating effect, for example.

The cooled transfer sheet P is ejected by a pair of sheet ejection rollers 71 and stacked on a sheet stack 75, provided in a left side of the printing unit 100 as illustrated in FIG. 1.

The sheet stack 75 can include a movable sheet-receiving tray (not shown), which can be moved in a vertical direction so that a larger amount of transfer sheets can be stacked in the sheet stack 75.

Furthermore, the transfer sheet P passed through the sheet stack 75 can be transported to another processing unit such as hole-punching unit, sheet-cutting unit, sheet-bending unit, and sheet-binding unit, for example.

As illustrated in FIG. 1, cleaning units 30A and 50A are provided at positions that face the rollers 33 and 55 respectively by sandwiching the second intermediate transfer belt 31 between the cleaning unit 30A and 50A and the respective rollers 33 and 55. The cleaning units 30A and 50A remove foreign objects such as paper powder and toners remaining on the second intermediate transfer belt 31 after transporting the transfer sheet P to the fixing unit 60.

As illustrated in FIG. 1, the bottle compartment 85 includes the toner bottles 86Y, 86M, 86C, and 86K therein, wherein the toner bottles 86Y, 86M, 86C, and 86K store fresh toners of yellow, magenta, cyan, and black, respectively. Furthermore, the toner bottles 86Y, 86M, 86C, and 86K are detachable from the bottle compartment 85. The bottle compartment 85 is provided on the top face of the printing unit 100 and a backward of the printing unit 100 (i.e., the bottle compartment 85 is far from a front side where a user operates the image forming apparatus 10). Therefore, a flat face can be secured on the top face of the printing unit 100, and a user can use such a flat face for placing something such as sheets.

With the above-mentioned toner supply unit (not shown), toners can be supplied to the developing unit 5, as required.

In an example embodiment, same color toner can be supplied to the corresponding developing unit 5 in the first image forming section 20 and the second image forming section 30 from a common toner bottle containing one color toner. However, one color toner can be supplied to the corresponding developing unit 5 in the first image forming section 20 and the second image forming section 30 from different toner bottles storing the one color toner.

In the case of the toner bottle 86K, the toner bottle 86K can be formed to have a larger capacity compared to the other toner bottles 86Y, 86M, and 86C because the black toner is consumed in a shorter period of time compared to other color toners, in general. Depending on a usage of the image forming apparatus 10, a size of toner bottles 86Y, 86M, 86C, and 86K can also be varied, as required.

As illustrated in FIG. 1, the operation/display unit 90 is provided on the top face of the printing unit 100. The operation/display unit 90 includes a keyboard to input operating information such as image forming conditions. The operation/display unit 90 also includes a display such as a liquid crystal display (LCD) to display information thereon. An operator can use the display to facilitate information communication with the printing unit 100.

As illustrated in FIG. 1, the printing unit 100 also includes a waste toner compartment 87, which is detachably provided in a lower portion of the printing unit 100. The waste toner compartment 87 is connected to the cleaning units 2, 20A, 30A, and 50A, and is separate from the cleaning units 2, 20A, 30A, and 50A. The waste toner compartment 87 recovers foreign objects such as paper powder and waste toner from the cleaning units 2, 20A, 30A, and 50A, and stores foreign objects therein. Accordingly, the cleaning units 2, 20A, 30A, and 50A can be miniaturized by providing the waste toner compartment 87 having a larger capacity to store the collected foreign objects. Furthermore, the waste toner compartment 87 can be easily detached from the image forming apparatus 10 when discarding recovered foreign objects such as paper powder and waste toner. The waste toner compartment 87 can be provided with a sensor (not shown) to detect an amount of recovered foreign objects such as paper powder and waste toner in the waste toner compartment 87, and an alarm signal can be generated based on the sensor information when a replacement of the waste toner compartment 87 is required for discarding foreign objects such as paper powder and waste toner.

As illustrated in FIG. 1, the printing unit 100 includes the controller 95. The controller 95 includes power sources and control circuits placed on a circuit frame.

As illustrated in FIG. 1, the printing unit 100 also includes a fan 96. Due to a heat generation at the fixing unit 60 and other units, temperature increases in the image forming apparatus 10, which is not a favorable phenomenon. The fan 96 is provided in the printing unit 100 to mitigate an effect of heat, which may cause functional degradation of parts in the image forming apparatus 10. The fan 96 can be connected to the heat-pipe rollers of the cooling unit 70 to improve a cooling effect of the cooling unit 70.

As illustrated in FIG. 1, the automatic document feeder (ADF) 200 is provided on the sheet feed unit 40. The ADF 200 can automatically feed document sheets when reading images of a document. The information read by the ADF 200 is transmitted to the controller 95. Based on such information, the controller 95 controls the printing unit 100 to produce an image pattern read by the ADF 200.

Furthermore, a personal computer (not shown) can transmit image information to the printing unit 100, and the printing unit 100 can produce an image corresponding to such image information.

Furthermore, image information can be transmitted to the printing unit 100 from a telephone line (not shown), and the printing unit 100 can produce an image corresponding to such image information.

Hereinafter, an image forming process for forming a full-color toner image on one face of the transfer sheet P with the printing unit 100 is explained. Such a process can be referred as a one-face recording method.

The one-face recording method includes two types, which can be selected by an operator. A first type method is a process to transfer a four-color toner image to the first face of the transfer sheet P from the first intermediate transfer belt 21. A second type method is a process to transfer a four-color toner image to the second face of the transfer sheet P from the second intermediate transfer belt 31.

If images are produced on a plurality of transfer sheets, it is preferable to control an image forming sequence so that the plurality of transfer sheets can be stacked on the sheet stack 75 sequentially.

The above-mentioned first type method can record images on transfer sheets in an order of from the last page to front page of document. The above-mentioned second type method can record images on transfer sheets in an order of from the front page to last page of document.

Hereinafter, an image forming process using the first image forming section 20 for the above-mentioned first type method is explained.

When the printing unit 100 is operated for image forming, the first intermediate transfer belt 21 and the photosensitive members 1Y, 1M, 1C, and 1K in the first process units 80Y, 80M, 80C, and 80K rotate. At the same time, the photosensitive members 1Y, 1M, 1C, and 1K in the second process units 81Y, 81M, 81C, and 81K are disengaged from the second intermediate transfer belt 31, and are controlled to be in a non-rotating condition although the second intermediate transfer belt 31 travels in a counter-clockwise direction as shown by an arrow in FIG. 1.

Then, the first process unit 80Y starts an image forming process.

The optical writing unit 4, including an LED (light emitting diode) array and a focusing device, emits a light beam from the LED array, corresponding to the yellow image data, to form an electrostatic latent image for a yellow image on the surface of the photosensitive member 1Y, which is uniformly charged by the scorotron charger 3. The electrostatic latent image is developed as the yellow toner image by the developing unit 5 in the first process unit 80Y, and the yellow toner image is then electro-statistically transferred to the first intermediate transfer belt 21 at a primary transfer nip for the yellow image.

Similarly, such developing and primary transfer processes are sequentially conducted on the photosensitive members 1M, 1C, and 1K with a predetermined timing. Then, magenta, cyan, and black toner images are sequentially and superimposingly transferred on the yellow toner image formed on the first intermediate transfer belt 21 at the respective primary transfer nips for magenta cyan, and black images.

With such a transfer process, a four-color toner image is formed on the first intermediate transfer belt 21.

As for the sheet feed unit 40, a transfer sheet P matched to a to-be-produced image can be supplied from any one of the sheet feed trays 40*a*, 40*b*, 40*c*, and 40*d* by using the feed devices 41A, 41B, 41C, and 41D.

Then, the pair of transport rollers 42B transport the transfer sheet P to the sheet feed route 43A in the printing unit 100. Then, the transfer sheet P is transported to the cross-direction position corrector 44.

The cross-direction position corrector 44 corrects an orientation of the transfer sheet P if the transfer sheet P is tilted from a predetermined transport direction when the transfer sheet P is transported from the sheet feed unit 40 to the first image forming section 20. Upstream of the transport direction with respect to the pair of registration rollers 45, the cross-direction position corrector 44 includes a guide plate (not shown), provided on each lateral side of the sheet feed route 43A. Each guide plate (not shown) can be abutted to a lateral side of the transfer sheet P from each lateral side of the transfer sheet P to correct the orientation of the transfer sheet P if the transfer sheet P is tilted from the predetermined transport direction. A distance between the two guide plates can be adjusted in a direction perpendicular to the transport direction, by which the distance between the two guide plates can be adjusted depending on the type of transfer sheet fed from the sheet feed unit 40. Therefore, such guide plates can be used for a variety of different types of transfer sheets fed from the sheet feed unit 40.

After correcting orientation of the transfer sheet P with the cross-direction position corrector 44, the transfer sheet P is fed to the pair of registration rollers 45. The registration rollers 45 feed the transfer sheet P to the secondary transfer nip defined by the roller 28 and the secondary transfer roller 46 with a predetermined timing.

At the secondary transfer nip, the four-color toner image formed on the first intermediate transfer belt 21 is transferred to the first face of the transfer sheet P.

After transferring the four-color toner image to the first face of the transfer sheet P at the secondary transfer nip, the outer face of the first intermediate transfer belt 21 is cleaned by the cleaning unit 20A to remove toners remaining on the first intermediate transfer belt 21.

At each of the first process units 80Y, 80M, 80C, and 80K, the respective cleaning units 2 clean the respective photosensitive members 1Y, 1M, 1C, and 1K to remove toners remaining on the photosensitive members 1Y, 1M, 1C, and 1K after transferring toner images to the first intermediate transfer belt 21 from the photosensitive members 1Y, 1M, 1C, and 1K. As illustrated in FIG. 2, each cleaning unit 2 includes a cleaning brush 2*a* and cleaning blade 2*b* to remove toners remaining on the photosensitive member 1Y, 1M, 1C, and 1K. Removed foreign objects such as toner are collected by the collector 2*c*, and then sent to the waste toner compartment 87.

The electric potential sensor S1 detects electric potential of the surface of the photosensitive member 1 scanned by a light beam. The image sensor S2 detects toner concentration adhered on the surface of the photosensitive member 1 after developing the electrostatic latent image as a toner image. The electric potential sensor S1 and the image sensor S2 transmit information to the controller 95, and the controller 95 adjusts image forming conditions based on such information.

After cleaning the surface of the photosensitive member 1 with the cleaning unit 2, the de-charging unit Q de-charges the photosensitive member 1 to prepare for a next image forming process.

As illustrated in FIG. 1, the transfer sheet P having the four-color toner image on its first face is transported onto the second intermediate transfer belt 31, and then transported to the fixing unit 60.

Before transporting the transfer sheet to the fixing unit 60 from the second intermediate transfer belt 31, a de-charger 58 applies electric charges to the transfer sheet P. With such electric charges, the transfer sheet P adhered electro-statistically to the second intermediate transfer belt 31 can be easily separated from the second intermediate transfer belt 31.

In the fixing unit 60, toners in the full-color toner image on the first face of the transfer sheet P are melted by heat.

Because the full-color toner image is formed only on the first face of the transfer sheet P, heat energy for fixing the full-color toner image on the transfer sheet P is smaller than heat energy for fixing full-color toner image on both faces (i.e., first and second face) of the transfer sheet P. The controller 95 controls electric power to be supplied to the fixing unit 60 at a preferable level depending on the image forming condition.

However, toners on the transfer sheet P may not be completely fixed on the transfer sheet in the fixing unit 60. If toners are not completely fixed on the transfer sheet P, an image quality of the full-color toner image may be degraded if the transfer sheet P is scratched by a component, provided along a transport route to the outside of the image forming apparatus 10, by which unfavorable phenomenon such as image drop and image disturbance may occur.

To prevent such a drawback, the transfer sheet P, passed through the fixing unit 60, is then fed to the cooling unit 70.

After the full-color toner image is completely fixed on the transfer sheet P in the cooling unit 70, the transfer sheet P is ejected to the sheet stack 75 by the pair of sheet ejection rollers 71.

At the sheet stack 75, ejected transfer sheets are sequentially stacked one by one in an order of "from last page to front page" of the document read by the ADF 200, and thereby a page order of the ejected transfer sheets can be collated at the sheet stack 75. The sheet stack 75 can be configured to be moved to a downward direction with an increase of numbers of ejected transfer sheets, by which transfer sheets can be stacked with an order of "from last page to front page" of the document read by the ADF 200.

Furthermore, instead of stacking the transfer sheets directly on the sheet stack 75, transfer sheets can be transported to another processing unit such as a hole-punching unit, sorting unit, collating unit, sheet-cutting unit, sheet-bending unit, and sheet-binding unit, for example.

In the above explanation, a method of transferring a four-color toner image to the first face of the transfer sheet from the first intermediate transfer belt 21 is explained.

Similarly, the above-mentioned second type method for transferring a four-color toner image to the second face of the transfer sheet from the second intermediate transfer belt 31 can be used to record an image on one face of the transfer sheet. In this case, instead of using the first process units 80Y, 80M, 80C, and 80K, an image forming is conducted by using the second process units 81Y, 81M, 81C, and 81K.

The above-mentioned first and second type methods can record images on transfer sheets with a substantially similar manner to each other except that the second type method can record images in an order of "from the front page to last page" of a document read by the ADF 200. Therefore, an explanation for forming an image on one face of a transfer sheet with the second process units 81Y, 81M, 81C, and 81K is omitted.

Hereinafter, a both-face image forming method for forming images on both faces (i.e., first and second faces) of a transfer sheet P is explained.

When image signals are input to the printing unit 100, yellow, magenta, cyan, and black toner images are formed on the respective photosensitive members 1Y, 1M, 1C, and 1K in the first process units 80Y, 80M, 80C, and 80K as explained in the above described one-face image forming method. Then, yellow, magenta, cyan, and black toner images are sequentially and super-imposingly transferred to the first intermediate transfer belt 21 at each primary transfer nip for Y, M, C, and K images.

When Y, M, C, and K toner images are formed in the first process units 80Y, 80M, 80C, and 80K, Y, M, C, and K toner images are also formed on the photosensitive members 1Y, 1M, 1C, and 1K in the second process units 81Y, 81M, 81C, and 81K in a substantially concurrent manner.

Similar to the first intermediate transfer belt 21, the Y, M, C, and K toner images are sequentially and super-imposingly transferred to the second intermediate transfer belt 31 at each primary transfer nip for Y, M, C, and K toner images.

With such processes, the four-color toner image is formed on each of the first intermediate transfer belt 21 and the second intermediate transfer belt 31.

Then, the pair of registration rollers 45 feed a transfer sheet P to the secondary transfer nip, defined by the second transfer roller 46, with a predetermined timing to transfer the four-color toner image to the first face of the transfer sheet P from the first intermediate transfer belt 21, and then the transfer sheet P is transported onto the second intermediate transfer belt 31.

At the secondary transfer nip, defined by the transfer charger 47, the four-color toner image is transferred to the second face of the transfer sheet P from the second intermediate transfer belt 31.

With such a process, the full-color toner image is formed on both faces (i.e., first and second faces) of the transfer sheet P.

Then, the transfer sheet P is separated from the second intermediate transfer belt 31 with an effect of the de-charger 58, and transported to the fixing unit 60. In the fixing unit 60, a fixing process using heat and pressure is conducted on the transfer sheet P to melt the toner images on the both faces (i.e., first and second face) of the transfer sheet P.

Then, the transfer sheet P is fed to the cooling unit 70, and then ejected to the sheet stack 75 by the pair of sheet ejection rollers 71.

In the case of forming images on both faces (i.e., first and second faces) of a plurality of transfer sheets, a stacking sequence of the transfer sheets on the sheet stack 75 is controlled so that a first transfer sheet, having an image of page 1 and an image of page 2 of the document on both faces of the first transfer sheet, can be stacked on a surface of the sheet stack 75 by facing the image of page 1 to the surface of the sheet stack 75.

Similarly, a second transfer sheet, having an image of page 3 and an image of page 4 of the document on both faces of the second transfer sheet, is stacked on the page 2 of the first transfer sheet by facing the image of page 3 of the second transfer sheet to the image of page 2 of the first transfer sheet. Such stacking is continued for each transfer sheet having images on its both faces. After finishing such stacking, a bundle of the transfer sheets can be picked up from the sheet stack 75.

Accordingly, a page order of the transfer sheets can be set from "page 1, page 2, page 3, and so on."

The controller 95 can control such an image forming sequence of the transfer sheets and adjust electric power to be supplied to the fixing unit 60. For example, the controller 95 controls electric power to a higher level when conducting a both-face image forming mode compared to one-face image forming mode.

In the above, a method of forming full-color image on one face or both faces (i.e., first and second faces) of a transfer sheet is explained, but such method can be also used for forming a monochrome image on one face or both faces (i.e., first and second faces) of a transfer sheet.

As for the image forming apparatus 10, if a maintenance work or replacement work is required for the image forming apparatus 10, an outer cover (not shown) can be opened to conduct the maintenance work or replacement work. Once the outer cover (not shown) is opened, replacement units or parts can be removed from the image forming apparatus 10.

In the image forming apparatus 10, the printing unit 100 includes the first image forming section 20 and the second image forming section 30 as above-mentioned. The first image forming section 20 includes the photosensitive member 1Y, 1M, 1C, and 1K for the respective first process units 80Y, 80M, 80C, and 80K as above-mentioned. The second image forming section 30 includes the photosensitive member 1Y, 1M, 1C, and 1K for the respective second process units 81Y, 81M, 81C, and 81K as above-mentioned.

In the image forming apparatus 10, the printing unit 100 includes the first image forming section 20 and the second image forming section 30 to form images on both faces (i.e., first and second faces) of the transfer sheet P.

The first image forming section 20 includes the primary transfer roller 22. With an effect of the primary transfer roller 22, toner images are super-imposingly transferred to the surface of the first intermediate transfer belt 21 from the photosensitive members 1Y, 1M, 1C, and 1K in the first image forming section 20. Therefore, the primary transfer rollers 22 function as primary transfer unit in the first image forming section 20.

The first intermediate transfer belt 21 is an endless type belt, and travels in a clockwise direction as shown in FIG. 1 when toner images are super-imposingly transferred to the surface of the first intermediate transfer belt 21 from the photosensitive members 1Y, 1M, 1C, and 1K.

Furthermore, the first image forming section 20 includes the secondary transfer roller 46 as a secondary transfer unit. With an effect of the secondary transfer roller 46, toner images are super-imposingly transferred to the first face of the transfer sheet P from the first intermediate transfer belt 21.

The second image forming section 30 includes the primary transfer rollers 32. With an effect of the primary transfer rollers 32, toner images are super-imposingly transferred to the surface of the second intermediate transfer belt 31 from the photosensitive members 1Y, 1M, 1C, and 1K in the second image forming section 30. Therefore, the primary transfer rollers 32 function as a primary transfer unit in the second image forming section 30.

The second intermediate transfer belt 31 is an endless type belt, and travels in a counter-clockwise direction as shown in FIG. 1 when toner images are super-imposingly transferred to the surface of the first intermediate transfer belt 31 from the photosensitive members 1Y, 1M, 1C, and 1K.

Furthermore, the first image forming section 30 includes the transfer charger 47 as a secondary transfer unit. With an effect of the transfer charger 47, toner images are super-imposingly transferred to the second face of the transfer sheet P from the second intermediate transfer belt 31.

After the toner images are super-imposingly transferred to the second face of the transfer sheet at the transfer charger 47, the transfer sheet P is supported on the surface of the second intermediate transfer belt 31 and transported to the fixing unit 60 with a traveling movement of the second intermediate transfer belt 31.

Then, the transfer sheet P is directly transported to the fixing unit 60 from the second intermediate transfer belt 31.

With such a configuration, the toner image can be transferred to both faces (i.e., first and second faces) of the transfer sheet by the first image forming section 20 and second image forming section 30 before transporting the transfer sheet P to the fixing unit 60 with a one-path system.

Furthermore, as above-mentioned, each of the first image forming section 20 and second image forming section 30 includes four photosensitive members 1 in a tandem arrangement. In the case of the first image forming section 20, the four photosensitive members 1 are arranged in a tandem manner along the first intermediate transfer belt 21, and toner images are super-imposingly transferred to the first intermediate transfer belt 21 and subsequently on the first face of the transfer sheet P. In the case of the second image forming section 30, the four photosensitive members 1 are arranged in a tandem manner along the second intermediate transfer belt 31, and toner images are super-imposingly transferred to the second intermediate transfer belt 31 and subsequently to the second face of the transfer sheet P.

With such a configuration, a full-color image or monochrome image can be transferred to each face (i.e., first and second faces) of the transfer sheet P with a higher speed for printing.

In the image forming apparatus 10 according to the non-limiting embodiment of FIG. 1, a sheet receiving/releasing unit is not provided between the second intermediate transfer belt 31 and the fixing unit 60. Therefore, the transfer sheet P can be directly transported to the fixing unit 60 from the second intermediate transfer belt 31. Specifically, the second intermediate transfer belt 31 can transport the transfer sheet P until the transfer sheet P reaches the fixing unit 60 as illustrated in FIG. 1.

Therefore, an un-fixed toner image on the transfer sheet P may not be scratched by a sheet receiving/releasing unit such as a spur and transport belt when the transfer sheet is transported to the fixing unit 60 by the second intermediate transfer belt 31. Therefore, disturbance of the un-fixed toner image on the transfer sheet P can be suppressed.

Furthermore, the transfer sheet P can be transported from the intermediate transfer belt 31 to the fixing unit 60 in a substantially straight line direction (e.g., horizontal direction), and thereby sheet jamming at the fixing unit 60 can be prevented, and a printing speed in the image forming apparatus 10 can be increased.

In the second image forming section 30, the second intermediate transfer belt 31 is extended by a plurality of rollers including the roller 54.

As illustrated in FIG. 1, the second intermediate transfer belt 31 is inflected at the roller 54, provided at a closer position to the fixing unit 60. The transfer sheet P is released to the fixing unit 60 from such an inflected portion of the second intermediate transfer belt 31. At such an inflected portion, the second intermediate transfer belt 31 is extended by the roller 54 with a larger curvature of 1/R. Specifically, the second intermediate transfer belt 31 traveling toward the fixing unit 60 inverts its traveling direction at such inflected portion.

The transfer sheet P supported on the surface of the second intermediate transfer belt 31 cannot follow such significant change of traveling direction of the second intermediate transfer belt 31. Thereby, the transfer sheet P having stiffness is gradually separated from the second intermediate transfer belt 31 from a front edge of the transfer sheet P, and gradually approaches a fixing nip of the fixing unit 60.

When the front edge of the transfer sheet P is inserted in the fixing nip, the transfer sheet P can be released from the second intermediate transfer belt 31 to the fixing unit 60.

As illustrated in FIG. 1, the second intermediate transfer belt 31 faces the fixing unit 60 at the inflected portion.

Because the inflected portion is close to the fixing unit 60, which generates a larger amount of heat, the second intermediate transfer belt 31 preferably includes a base layer having good heat-resisting properties. Specifically, the base layer includes materials such as polyimide and polyamide, for example.

If the second intermediate transfer belt 31 is made as a single-layered structure, the base layer becomes the second intermediate transfer belt 31. If the second intermediate transfer belt 31 is made as a multi-layered structure, a layer having the greatest thickness becomes the base layer.

As above mentioned, if the base layer is made of materials such as polyimide and polyamide, an elongation and shrinking of the second intermediate transfer belt 31 with an effect of heat can be suppressed, and degradation of the second intermediate transfer belt 31 can be suppressed.

In the image forming apparatus 10, a transport speed of the second intermediate transfer belt 31 can be controlled depending on types of transfer sheets.

If a transfer sheet has a larger thickness, the fixing unit 60 needs a longer period of time to effectively heat such a transfer sheet for fixing toner images on the transfer sheet. To conduct an effective heating for such a transfer sheet by the fixing unit 60, a fixing time in the fixing unit 60 is required to be set to a longer time, and thereby a rotating speed of the heat rollers 61 and 62 in the fixing unit 60 is required to be set to a slower level or speed.

If the rotating speed of the heat rollers 61 and 62 is set to a slower level, a transport speed of the second intermediate transfer belt 31 for transporting the transfer sheet is also required to be set to a slower level, which matches the rotating speed of the heat rollers 61 and 62.

If the rotating speed of the heat rollers 61 and 62 and the transport speed of the second intermediate transfer belt 31 are different each other, such speed difference may cause an unfavorable effect such as scratching of an un-fixed toner image when the transfer sheet is transported from the second intermediate transfer belt 31 to the fixing unit 60.

Therefore, when a transfer sheet having a larger thickness is used, the rotating speed of the heat rollers 61 and 62 and the transport speed of the second intermediate transfer belt 31 are set to a same slower level.

For example, if a transfer sheet is heavy paper having a basis weight of 90 g/m$^2$ or greater, a transport speed of the second intermediate transfer belt 31 for transporting the heavy paper to the fixing unit 60 is reduced to one-half of a transport speed for transporting plain paper.

Hereinafter, the term of "heavy paper" is used to indicate a paper having a basis weight of 90 g/m$^2$ or greater, and the term of "plain paper" is used to indicate a paper having a basis weight of less than 90 g/m$^2$. In general, "plain paper" has a basis weight of approximately 50 g/m$^2$ to 80 g/m$^2$, and "heavy paper" has a basis weight of approximately 90 g/m$^2$ to 230 g/m$^2$, for example.

When the heavy paper is used as transfer sheet, a rotating speed of the heat rollers 61 and 62 in the fixing unit 60 is also reduced to one-half of a transport speed for plain paper. Therefore, the heavy paper is transported to the fixing unit 60 with one-half of a transport speed for plain paper to fix toner image on the heavy paper.

In the image forming apparatus 10, a type of transfer sheet can be judged as below.

At first, any one of the sheet feed trays 40*a*, 40*b*, 40*c*, and 40*d* stores heavy papers. When a transfer sheet is fed from the sheet feed tray storing heavy paper, a transport speed of the second intermediate transfer belt 31 and a rotating speed of the heat rollers 61 and 62 are controlled to one-half of transport speed for plain paper.

A sheet feed tray for storing heavy papers can also be designated as an apparatus specification in advance. In this case, a manufacturer specifically designates a sheet feed tray for storing heavy papers in an image forming apparatus.

If a sheet feed tray for storing heavy papers is not designated as an apparatus specification in advance, a user can designate a sheet feed tray for storing heavy papers. A user can designate a sheet feed tray storing heavy papers by inputting a sheet feed tray designation information from the operation/display unit 90 when a user sets heavy papers in one of the sheet feed trays 40*a*, 40*b*, 40*c*, and 40*d* in the image forming apparatus 10.

Furthermore, a paper detection sensor (not shown) can be provided along the sheet feed route 43A to detect a pass-through of heavy paper. If the paper detection sensor (not shown) detects a pass-through of heavy paper, a transport speed of the second intermediate transfer belt 31 and a rotating speed of the heat rollers 61 and 62 are changed to one-half of a transport speed for plain paper.

The paper detection sensor can include a transmissive optical sensor, for example, to detect an intensity of light which transmits a paper. The thicker the thickness of paper is, the smaller the intensity of light transmitting a paper becomes. The intensity of transmitting light for heavy paper can be stored in a memory (not shown) in advance as reference value.

When a transfer sheet passes through the sheet feed route 43A, the transmissive optical sensor detects an intensity of transmitting light, and the transmissive optical sensor outputs a signal matched to such light intensity. A computer (not shown) compares the reference value stored in the memory (not shown) and the signal output from the transmissive optical sensor. If the output signal of the transmissive optical sensor is smaller than the reference value stored in the memory (not shown), the computer (not shown) can judge that heavy paper passes through the sheet feed route 43A. Furthermore, the computer (not shown) can judge a pass-through time of heavy paper having a different size at the transfer charger 47.

As above-described, once the heavy paper passes through the transfer charger 47, the transporting speed of the intermediate transfer belt 31 is reduced to one-half compared to plain paper.

However, if a size of heavy paper is different, a pass-through time of the heavy paper at the transfer charger 47 becomes different. Therefore, a timing for reducing the transporting speed of the intermediate transfer belt 31 is required to set for each different size of heavy paper.

If the timing for reducing the transporting speed of the intermediate transfer belt 31 (hereinafter, speed reducing timing) is set to a same value regardless of the size of the heavy paper, the heavy paper may receive an unfavorable effect at the transfer charger 47.

For example, if the speed reducing timing is too early (i.e., the heavy paper does not completely pass through the transfer charger 47), an image disturbance may happen on the heavy paper because of a speed difference between the front and rear end portion of the heavy paper, in which a speed at the front end portion of the heavy paper is smaller than a speed at the rear end portion of the heavy paper. In this case, a secondary transfer of a toner image is still continuing at the secondary transfer nip defined by the transfer charger 47, and thereby a toner image to be formed on a rear end portion of the heavy paper may be disturbed by such speed difference.

Specifically, a sensor (not shown) is provided at a downstream of the transport direction with respect to the transfer charger 47 to detect a pass-through time of different sized heavy paper. The sensor (not shown) can be positioned closely to the transfer charger 47 so that a pass-through of the heavy paper can be detected right after the heavy paper passes through the transfer charger 47. The sensor (not shown) detects a time when the front edge of the heavy paper passes through the transfer charger 47, and a time when the rear edge of the heavy paper passes through the transfer charger 47. When the sensor (not shown) detects a front edge of the heavy paper, a computer (not shown) starts a time count.

In a memory (not shown) in the image forming apparatus 10, a table storing reference pass-through time for each size of heavy paper is memorized in advance. Size information of the heavy paper, which is transported in the image forming apparatus 10, can be obtained from several information such as image data input from a scanning unit or a sheet feed tray selected by a user. Based on the size information of heavy paper obtained in such a way, a reference pass-through time of a transported heavy paper can be retrieved from the memory (not shown).

When the computer (not shown) judges that an actual pass-through time of the transported heavy paper of one size substantially matches the reference pass-through time of such size, the computer (not shown) judges that the heavy paper of one size has passed through the transfer charger 47.

Based on such judgment, the computer (not shown) reduces a transport speed of the second intermediate transfer belt 31 to one-half of the transport speed for transporting plain paper at a suitable timing.

As for the image forming apparatus 10, toner having the following (a) to (d) properties is preferably used: (a) average circularity of from 0.90 to 0.99; (b) shape factor SF-1 of from 120 to 180; (c) shape factor SF-2 of from 120 to 190; and (d) ratio Dv/Dn of from 1.05 to 1.30, wherein Dv is the volume average particle diameter and Dn is the number average particle diameter.

A manufacturer or seller of an image forming apparatus can notify such recommended toner information to users with following methods: 1) shipping of toner having (a) to (d) properties with an image forming apparatus; 2) describing a product number or name of toner on an image forming apparatus or an operation manual; 3) informing a product number or name of toner to users with a document or electronic data; and 4) shipping of an image forming apparatus by setting toner bottles containing toners having (a) to (d) properties, for example.

Although the image forming apparatus 10 employs all of the above-mentioned methods for notifying the recommended toner information to users, one of the above-mentioned methods can be used instead of employing all of the above-mentioned methods.

The above-mentioned property (a) is recommended for the following reason.

The toner used in the non-limiting embodiment preferably has an average circularity from 0.90 to 0.99 such that the toner has good transferability and can produce high quality images with good dot reproducibility.

When the average circularity of the toner is too small (i.e., lower sphericity), the toner has a shape which is far from a spherical shape. In this case, the toner has poor transferability and thereby high quality images with high sharpness (i.e., without toner scattering) cannot be produced. Furthermore, when the average circularity of the toner is too small (i.e., lower sphericity), high quality images having a preferable concentration cannot be produced.

When the average circularity of the toner is too large (i.e., higher sphericity), an image forming apparatus employing a blade cleaning may experience a degradation of cleaning-ability of the blade against a to-be-cleaned member such as photosensitive member and intermediate transfer belt. In this case, lower quality images having stains may be more likely to be produced on a recording medium.

When an area of image to be produced is smaller, an amount of toners remaining on a photosensitive member after transfer process is relatively small, thereby cleaning-ability may not become significant issue. However, when an area of image to be produced is greater (e.g., color photography image), or when toners are remained on a photosensitive member due to troubles such as sheet jamming, cleaning-ability may become a significant issue.

In an example embodiment, the toner preferably has an average circularity of from 0.90 to 0.99, and preferably from 0.93 to 0.97, in which a ratio of toner particles having circularity of less than 0.94 is preferably adjusted to 10% or less of the toner.

The average circularity of toner is measured as below. Samples of suspension including toner particles are passed through a flow cell that transforms the particle suspension into a narrow flow, ensuring that the largest area of the particle is oriented towards a CCD (charge-coupled device) camera. The CCD camera captures particle images and these images are analyzed.

The circularity of a particle is determined by the following equation:

$$\text{Circularity}=Cs/Cp$$

wherein Cp represents the length of the circumference of the projected image of a particle, and Cs represents the length of the circumference of a circle having the same area as that of the projected image of the particle.

The average circularity of toner is measured by averaging each value of Circularity (=Cs/Cp). The average circularity of toner may be measured using a flow particle image analyzer FPIA-2100 manufactured by SYSMEX Co., Ltd.

Each sample is prepared as indicated below for measurement of the circularity of toner. At first, purified water of 100 to 150 ml is poured in a vessel. Then, 0.1 to 0.5 ml of surfactant (preferably alkylbenzene sulfonic acid salt) is added to the water as dispersing agent. And then, a sample of 0.1 to 0.5 g is added to the solution. The mixed solution is dispersed for one to three minutes by an ultrasonic dispersion apparatus. After adjusting concentration of the dispersed solution to a level of 3,000 to 10,000 particles per μl, toner shape distribution is measured.

The above-mentioned properties (b) and (c) are recommend for the following reasons.

The shape factors SF-1 and SF-2 are parameters for expressing shape of toner, which are widely used in a field of powder technology.

Figure 4:
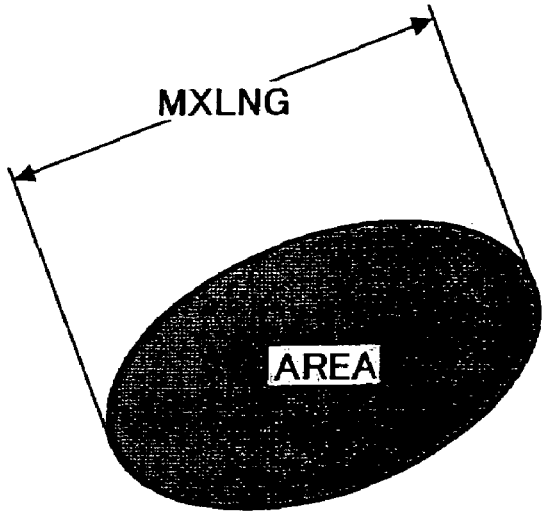
FIG. 4 is a schematic view for explaining shape factor SF-1.

As illustrated in FIG. 4, the shape factor SF-1 represents the degree of the roundness of a toner and is defined by the following equation (1):

$$SF\text{-}1=\{(MXLNG)^2/(\text{AREA})\}\times(100\pi/4) \quad (1)$$

wherein MXLNG represents a diameter of the circle circumscribing the image of a toner particle, which image is obtained by observing the toner particle with a microscope; and AREA represents the area of the image.

When the SF-1 is 100, the toner particle has a true spherical form. In this case, the toner particles contact the other toner particles and the photosensitive member serving as an image carrying member at one point. Therefore, the adhesion of the toner particles to the other toner particles and the photosensitive member decreases, resulting in increase of the fluidity of the toner particles and the transferability of the toner.

When the SF-1 is too large, the toner particles have irregular forms and thereby the toner has poor developability and poor transferability.

Figure 5:
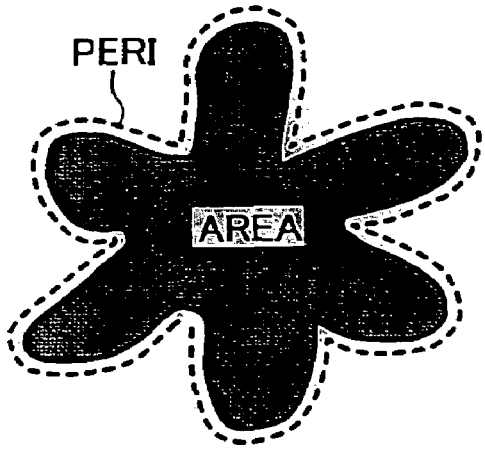
FIG. 5 is a schematic view for explaining shape factor SF-2.

As illustrated in FIG. 5, the shape factor SF-2 represents the degree of the concavity and convexity of a toner particle, and is defined by the following equation (2):

$$SF\text{-}2=\{(PERI)^2/(\text{AREA})\}\times(100/4\pi) \quad (2)$$

wherein PERI represents the peripheral length of the image of a toner particle observed by a microscope; and AREA represents the area of the image.

When the SF-2 approaches 100, the toner particles have a smooth surface (i.e., the toner has few concavity and convexity).

It is preferable for a toner to have a slightly roughened surface to obtain good clean-ability of the toner. However, when the SF-2 is too large (i.e., the toner particles are seriously roughened), a toner scattering problem (i.e., toner particles are scattered around a toner image) is caused, resulting in deterioration of the toner image qualities.

When the SF-1 and SF-2 is closer and closer to 100, the toner particle has a true spherical form. In this case, the toner particles contact the other toner particles and the photoconductive member serving as an image carrying member at one point. Therefore, the adhesion of the toner particles to the other toner particles and the photoconductive member decreases, resulting in increase of the fluidity of the toner particles and the transferability of the toner.

Furthermore, when the shape factors SF-1 and SF-2 becomes too large (e.g., when SF-1 exceeds 180 and SF-2 exceeds 190), the toner particles have irregular forms and thereby the toner has poor developability and poor transferability.

However, when the toner has a form near the spherical form, the cleaning problem tends to occur, particularly for a mechanical cleaning such as blade cleaning. Such cleaning problem may be caused because toner particles having increased fluidity may easily pass through a small gap formed between a cleaning member (e.g., blade) and a to-be-cleaned member (e.g., photosensitive member). When the shape factors SF-1 and SF-2 become smaller (e.g., when SF-1 and SF-2 are less than 120), the cleaning problem tends to occur significantly.

In contrast, when the toner has a form far away from the spherical form, the toner has good clean-ability, but the dot reproducibility and transfer efficiency deteriorate, resulting in deterioration of image qualities.

Accordingly, in an example embodiment, the shape factor SF-1 is preferably set to from 120 to 180, and the shape factor SF-2 is preferably set to from 120 to 190.

The shape factors SF-1 and SF-2 are determined by the following method (1)-(3):

(1) 100 particles of a toner are photographed using a scanning electron microscope (Field Emission Scanning Electron Microscope S-800 manufactured by Hitachi Ltd.);

(2) photographed images of 100 toner particles are analyzed using an image analyzer (LUZEX 3 manufactured by Nireco Corp.) to determine the SF-1 and SF-2 with MXLING, AREA, and PERI; and (3) The shape factors SF-1 and SF-2 are determined as average value of 100 toner particles.

The above-mentioned property (d) is recommended for the following reason.

A ratio Dv/Dn is a ratio of the volume average particle diameter Dv to the number average particle diameter Dn. Therefore, the ratio Dv/Dn is a parameter expressing the particle diameter distribution of toner.

The toner used in an example embodiment has a ratio Dv/Dn of from 1.05 to 1.30, and preferably has a ratio Dv/Dn of from 1.10 to 1.25. Such toner having a narrower particle diameter distribution has favorable aspect as below. For example, the toner having a volume average particle diameter Dv of from 4.0 to 8.0 μm and a ratio Dv/Dn of from 1.05 to 1.30 has following favorable aspect.

In general, toner particles having a particle diameter matched to a pattern of an electrostatic latent image are preferentially used to develop the electrostatic latent image compared to other toner particles not matched to the pattern of the electrostatic latent image, and thereby various types of image patterns can be produced effectively.

If an image forming apparatus employs a recycling configuration to recover toners remaining on an image carrying member (e.g., photosensitive member) and to reuse such recovered toners, toner particles having a relatively smaller size are more likely to be recovered by recycling because smaller toner particles are less likely to be used for image forming.

If toners having a relatively larger particle diameter distribution are used and recycled, a variation of particle diameter distribution of toners changes significantly when the toner is consumed for image forming over time. For example, when image forming operations are conducted, smaller toner particles are more likely to remain in a developing unit as above-explained. If fresh toners particles are supplied in such a developing unit and image forming operations and toner recycling are conducted further, a ratio of smaller toner particles in the developing unit becomes higher, by which a particle diameter distribution of toners in the developing unit shifts to a smaller level over time because larger toner particles are more likely to be consumed for image forming. If particle diameter distribution of toners in the developing unit changes significantly, developability of toners may deteriorate.

Therefore, toners having a narrower particle diameter distribution are preferable.

When the volume average particle diameter Dv of the toner is too small and such toner is used in a two-component developer, such toner may be fixed on a surface of an carrier with an effect of agitation in a developing unit over time, by which the charging capability of the carrier in the two-component developer may degrade. When the volume average particle diameter Dv of the toner is too small and such toner is used as one-component developer, the toner may be more likely to be filmed on a developing roller, or the toner may be more likely to fixed on a member (e.g., blade) used for leveling a thickness of toner on the image carrying member.

When the volume average particle diameter Dv of the toner is too large, higher resolution images cannot be produced, and in addition, the particle diameter distribution of the toner changes significantly when the toner is consumed by image forming operations.

Accordingly, the toner having a volume average particle diameter Dv of from 4.0 μm to 8.0 μm and a ratio Dv/Dn of from 1.05 to 1.30 is preferably used in the non-limiting embodiment.

The particle diameter distribution of toner can be measured with a measurement device using the Coulter Principle. For example, the particle diameter distribution of the toner may be measured with COULTER COUNTER TA-II or COULTER Multisizer II (manufactured by Beckman Coulter, Inc.). Each sample is prepared as below for measurement of the particle diameter distribution of toner.

At first, an electrolytic solution including purified water of 100 to 150 ml and first grade NaCl is prepared as approximately 1% NaCl solution (sodium and potassium solution), and such 1% NaCl solution is poured in a vessel. Isoton® II (a balanced electrolytic solution manufactured by Beckman Coulter, Inc.) can used, for example.

Then, 0.1 to 0.5 ml of surfactant (preferably alkylbenzene sulfonic acid salt) is added to the solution as a dispersing agent. And then, a sample of 2 to 20 mg is added to the solution. The mixed solution is dispersed for one to three minutes by an ultrasonic dispersion apparatus. Then the volume distribution and numbers distribution are computed by measuring volume and numbers of toner particles using an aperture of 100 μm.

The volume average particle diameter Dv and the number average particle diameter Dn can be obtained from volume distribution and numbers distribution of toner particles.

The measurement uses thirteen channels: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm.

The measurement is conducted for toner particles having a particle diameter of 2.00 μm to less than 40.30 μm.

In an example embodiment, the controller 95 controls a transport speed of the second intermediate transfer belt 31 and the rotating speed of the heat rollers 61 and 62 based on thickness information (i.e., basis weight) of the transfer sheet, which distinguishes types of transfer sheets.

However, the controller 95 can use other information of a transfer sheet to control the transport speed of the second intermediate transfer belt 31 and the rotating speed of the heat rollers 61 and 62.

For example, the controller 95 can use surface roughness Ra of a transfer sheet to control a transport speed of the second intermediate transfer belt 31 and the rotating speed of the heat rollers 61 and 62. The larger the surface roughness Ra of transfer sheet is, the harder to increase a temperature of a toner image on the transfer sheet. Therefore, if the surface roughness Ra of transfer sheet is too large, the transport speed of the second intermediate transfer belt 31 and the rotating speed of the heat rollers 61 and 62 are decreased.

With such controlling, a toner image on the transfer sheet having a larger surface roughness Ra can be effectively heated to a toner melting temperature to fix toner images on the transfer sheet.

An optical sensor (not shown) for detecting the surface roughness Ra of transfer sheet can be provided between the pair of registration rollers 45 and the secondary transfer nip in the image forming section 20, for example. The optical sensor can include a reflection type sensor, which detects the surface roughness Ra of transfer sheet based on an intensity of light reflected from the transfer sheet. The intensity of light reflected from the transfer sheet varies depending on surface roughness Ra of transfer sheet. When the surface of transfer sheet is too rough, a light irradiated on the transfer sheet reflects diffusingly. Thereby, the light intensity of the reflected light for the transfer sheet having a larger roughness is smaller than a light intensity of reflected light of the transfer sheet having a smaller roughness. Therefore, when the transfer sheet having a larger roughness is used, the optical sensor receives a reflected light having smaller light intensity, and thereby the optical sensor outputs a signal having a smaller value. When the optical sensor outputs a signal having a value smaller than a reference value (e.g., value for reference sheet), the controller judges that a transfer sheet has a rough surface, and changes the transport speed of the second intermediate transfer belt 31 and the rotating speed of heat rollers 61 and 62 to one-half speed of a transfer sheet having smoother surface when the transfer sheet passes through the transfer charger 47, for example.

Figure 6:
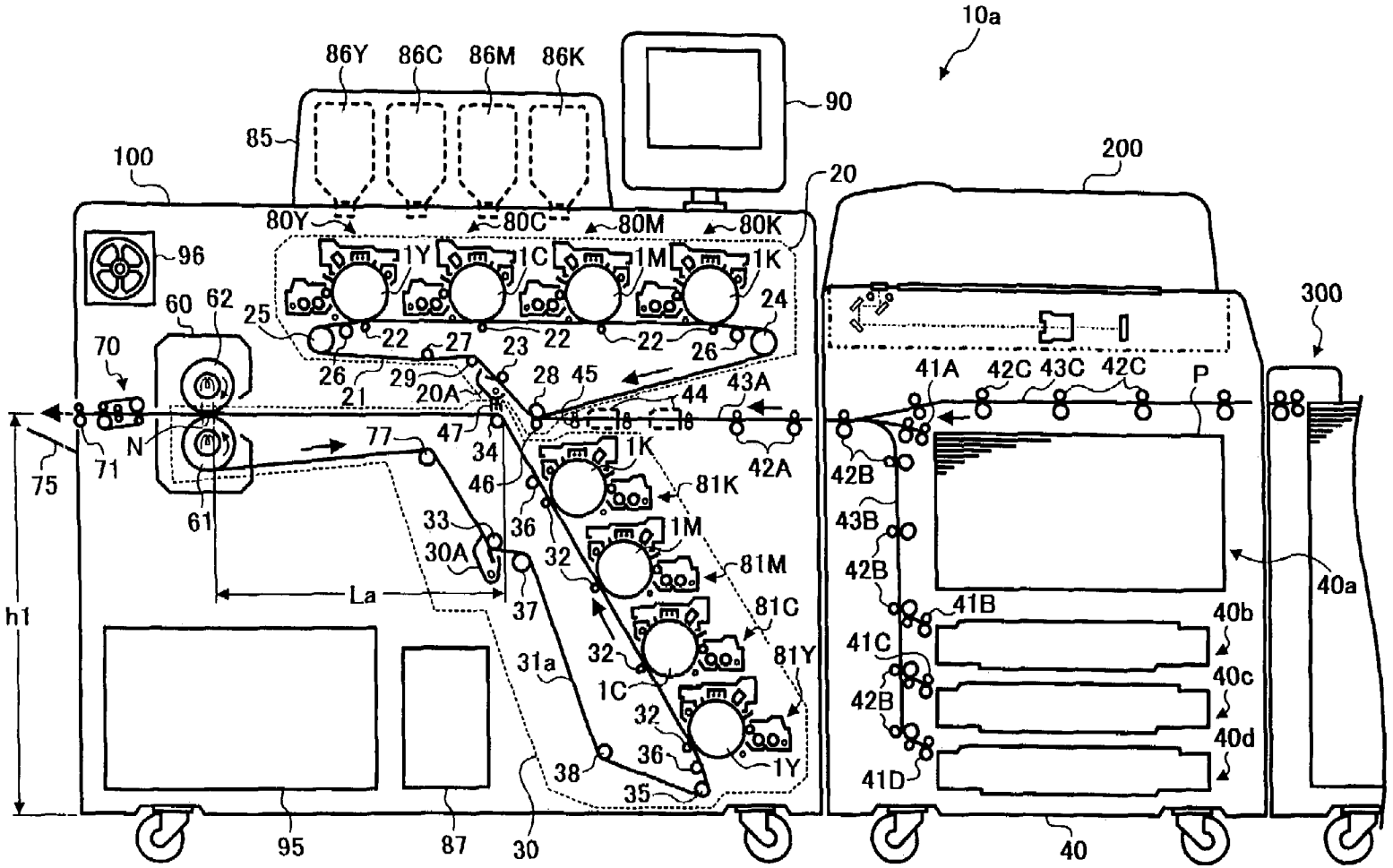
FIG. 6 is a schematic configuration of another image forming apparatus according to another embodiment of the present invention, in which a second intermediate transfer belt directly transports a transfer sheet to a fixing nip of a fixing unit.

FIG. 6 is a schematic configuration of another image forming apparatus 10*a* according to another non-limiting embodiment, in which a second intermediate transfer belt 31*a* directly transports a transfer sheet to a fixing nip N in the fixing unit 60.

As illustrated in FIG. 6, the second intermediate transfer belt 31*a* is extended by a plurality of rollers similar to the second intermediate transfer belt 31 in FIG. 1 except that the second intermediate transfer belt 31*a* is extended by the heat roller 61, by which there is no gap between the second intermediate transfer belt 31*a* and the fixing nip N in the fixing unit 60.

In such a configuration, the transfer sheet P can be supported and transported by the second intermediate transfer belt 31*a* until the transfer sheet P reaches the fixing nip N. Therefore, the transfer sheet P can be transported from the secondary transfer nip, defined by the transfer charger 47, to the fixing unit 60 while the transfer sheet P is supported on a surface of the second intermediate transfer belt 31*a*, and thereby the un-fixed toner image on the surface on the transfer sheet P may not be disturbed.

In the above-explained image forming apparatus 10 (or 10*a*), the second intermediate transfer belt 31 (or 31*a*) can transport the transfer sheet P to the fixing unit 60. In such a configuration, the transfer sheet P can be transported to the fixing unit 60 without using a sheet receiving/releasing unit such as a spur and transport belt, and thereby the transfer sheet P is not scratched by the sheet receiving/releasing unit in the image forming apparatus 10 (or 10*a*).

Therefore, disturbance of un-fixed toner image on the transfer sheet P due to scratching by the sheet receiving/releasing unit can be prevented.

Furthermore, in the image forming apparatus 10 (or 10*a*), sheet jamming can be prevented because a sheet receiving/releasing unit is not provided in the image forming apparatus 10 (or 10*a*).

Furthermore, in the image forming apparatus 10 (or 10*a*), the controller 95 controls the transport speed of the second intermediate transfer belt 31 (or 31*a*) for transporting the transfer sheet to the fixing unit 60 based on types of transfer sheet.

When the transfer sheet P is heavy paper having a larger basis weight or when the transfer sheet P has a rough surface, which are hard to increase its temperature, the controller 95 controls the transport speed of the second intermediate transfer belt 31 (or 31*a*) and the rotating speed of the heat rollers 61 and 62 to be at a slower speed so that the transfer sheet can pass through the fixing unit 60 for a longer period of time. With such a controlling, toners can be effectively heated in the fixing unit 60, and thereby a fixing problem such as insufficient heating of toner can be prevented.

Furthermore, in the image forming apparatus 10 according to the non-limiting embodiment, a horizontally extended portion of the second intermediate transfer belt 31, extending from the transfer charger 47 to the fixing unit 60, has a length "L" as shown in FIG. 1, wherein the length "L" is set to be larger than a maximum size (i.e., length) of the transfer sheet P.

Similarly as illustrated in FIG. 6, a horizontally extended portion of the second intermediate transfer belt 31*a*, extending from the transfer charger 47 to the fixing nip N in the fixing unit 60, has a length "La," wherein the length "La" is set to be larger than a maximum size (i.e., length) of the transfer sheet P. With such a configuration, the front edge of the transfer sheet P is sandwiched at the fixing nip of the fixing unit 60 after the rear edge of the transfer sheet P goes out the secondary transfer nip, defined by the transfer charger 47.

Accordingly, the transfer sheet P is not simultaneously sandwiched at both of the secondary transfer nip defined by the transfer charger 47 and the fixing nip of the fixing unit 60. In other words, the transfer sheet P is sandwiched at either one of the rear edge or the front edge of the transfer sheet P.

If the transfer sheet P is sandwiched simultaneously at both of the front and rear edges of the transfer sheet P, the transfer sheet P is tensioned by the secondary transfer nip defined by the transfer charger 47 and the fixing nip of the fixing unit 60. In such a case, the transfer sheet P may be scratched with the second intermediate transfer belt 31 (or 31*a*), resulting in disturbance of an un-fixed toner image on the transfer sheet P.

Such a disturbance of an un-fixed toner image on the transfer sheet P can be suppressed in the image forming apparatus 10 (or 10*a*) because the transfer sheet P is sandwiched at the fixing nip of the fixing unit 60 only after the rear edge of the transfer sheet P exits the secondary transfer nip, defined by the transfer charger 47.

Furthermore, in the image forming apparatus 10 (or 10*a*) according to the non-limiting embodiments, the controller 95 controls the transport speed of the second intermediate transfer belt 31 (or 31*a*) based on the types of transfer sheets when the transfer sheet P passes through the transfer charger 47. In other words, a transfer sheet P such as heavy paper or rough surface paper can be transported with a transport speed for plain paper until the transfer sheet P passes through the secondary transfer nip defined by the transfer charger 47.

With such controlling of the transport speed, a total printing time for the transfer sheet P such as heavy paper or rough surface paper in the image forming apparatus 10 (or 10*a*) can be shortened compared to an image forming apparatus without such controlling, although the transport speed of the second intermediate transfer belt 31 (or 31*a*) is controlled to a slower speed when the transfer sheet P such as heavy paper or rough surface paper is transported from the second intermediate transfer belt 31 (or 31*a*) to the fixing unit 60.

Furthermore, because the transfer sheet P such as heavy paper and rough surface paper can be transported with a transport speed for plain paper until such transfer sheet passes through the transfer charger 47, a transport speed of the first intermediate transfer belt 21 and a rotating speed of the photosensitive members 1 are not required to be changed even if different types of transfer sheets are used. Therefore, a mechanism for controlling the transport speed of the first intermediate transfer belt 21 and the rotating speed of the photosensitive members 1 in the image forming section 20 can be designed simpler, and thereby the image forming apparatus 10 (or 10*a*) can be manufactured with a reduced cost.

Furthermore, in the image forming apparatus 10 (or 10*a*) according to the non-limiting embodiments, when the transfer sheet P has a basis weight of 90 g/m$^2$ or greater, or when the transfer sheet P is rough surface paper, which is hard to increase its temperature, the transport speed of the second intermediate transfer belt 31 (or 31*a*) is controlled to be one-half of the transport speed for plain paper, and the rotating speed of the heat rollers in the fixing unit 60 is controlled to be one-half of the transport speed for plain paper.

With such a controlling, a fixing time in the fixing unit 60 can be set to a longer period of time, and toners can be sufficiently heated for fixing even if such a transfer sheet (i.e., heavy paper and rough surface paper) is used. Accordingly, a fixing problem such as insufficient heating of toner can be prevented.

Furthermore, the controller 95 controls the fixing speed at the fixing unit 60 and the transport speed of the second intermediate transfer belt 31 (or 31*a*) at a same level according to types of transfer sheet. With such a controlling, the transfer sheet P can be transported from the second intermediate transfer belt 31 (or 31*a*) to the fixing unit 60 smoothly.

Furthermore, in the image forming apparatus 10 (or 10*a*) according to the non-limiting embodiments, the second intermediate transfer belt 31 (or 31*a*) is made of a heat resistance material such as polyimide and polyamide. For example, the base layer of the second intermediate transfer belt 31 (or 31*a*) can be made of polyimide and polyamide.

The second intermediate transfer belt 31 (or 31*a*) is susceptible to heat generated in the fixing unit 60 because the second intermediate transfer belt 31 (or 31*a*) transports the transfer sheet P at a position close to the fixing nip of the fixing unit 60, by which an elongation and shrinking of the second intermediate transfer belt 31 (or 31*a*) may occur. Such elongation and shrinking of the second intermediate transfer belt 31 can be suppressed by using a heat resistance material for the second intermediate transfer belt 31 (or 31*a*), and degradation of the second intermediate transfer belt 31 (or 31*a*) can be suppressed by using a heat resistance material.

Furthermore, in the image forming apparatus 10 (or 10*a*) according to the non-limiting embodiments, the second intermediate transfer belt 31 (or 31*a*) has a volume electric resistance of $10^6$ to $10^{12}$ Ω·cm to electro-statistically carry a toner image from the photosensitive member 1.

Furthermore, in the image forming apparatus 10 (or 10*a*) according to the non-limiting embodiments, the second intermediate transfer belt 31 (or 31*a*) includes an endless type belt.

Although not shown, if a belt having an end is used instead of the endless type belt, two winding rollers are provided at both ends of the belt, and one winding roller winds the belt to travel the belt in one direction so that an image forming operation can be conducted. After finishing one image forming operation, another winding roller winds the belt to travel the belt in the opposite direction so that a next image forming operation can be conducted. Therefore, when the belt travels in the opposite direction, an image forming operation cannot be conducted.

The image forming apparatus 10 (or 10*a*) can eliminate such drawbacks by using an endless type belt for the second intermediate transfer belts.

Furthermore, in the image forming apparatus 10 (or 10*a*) according to the non-limiting embodiments, the first intermediate transfer belt 21 and the second intermediate transfer belt 31 (or 31*a*) overlap each other without contacting each other when the first intermediate transfer belt 21 and the second intermediate transfer belt 31 (or 31*a*) are viewed from a top side of the printing unit 100 in a vertical direction.

The transfer sheet P is passed through a boundary space area formed between the first intermediate transfer belt 21 and the second intermediate transfer belt 31 (or 31*a*) to conduct an image transfer at the secondary transfer nips in the first image forming section 20 and the second image forming section 30. With such an overlapping configuration in a vertical direction, a space required for allocating the first and second image forming sections 20 and 30 in the horizontal direction in the printing unit 100 can be minimized, by which a compact layout can be designed for the image forming apparatus 10 (or 10*a*).

Furthermore, in the image forming apparatus 10 (or 10*a*) according to the non-limiting embodiments, the first intermediate transfer belt 21 occupies a space in the printing unit 100 in a horizontal direction rather than a vertical direction, and thereby the photosensitive members 1 can be disposed over a horizontally extended surface of the first intermediate transfer belt 21 as illustrated in FIG. 1.

Furthermore, in the image forming apparatus 10 (or 10*a*) according to the non-limiting embodiments, the sheet feed unit 40 is provided to a side direction of the first intermediate transfer belt 21 and the second intermediate transfer belt 31.

With such a configuration, the sheet feed unit 40 can feed the transfer sheet P to the sheet feed route 43A and the secondary transfer nips, formed in the first and second image forming sections 20 and 30, from a substantially horizontal direction (i.e., straight line without bending in vertical direction) as illustrated in FIG. 1.

With such a sheet feed configuration, sheet jamming in the sheet feed route 43A, extending from the sheet feed unit 40 to the secondary transfer nips in the first and second image forming sections 20 and 30, can be suppressed, and such a sheet feed route configuration extending substantially in a horizontal direction is preferable for a higher speed printing.

Furthermore, in the image forming apparatus 10 (or 10*a*) according to the non-limiting embodiments, as illustrated in FIG. 1, the sheet feed route 43A extending from the sheet feed unit 40 to the fixing unit 60 is a substantially straight line route without bending in vertical direction. With such a configuration, sheet jamming can be prevented over all of the sheet feed route 43A in the image forming apparatus 10 (or 10*a*), and thereby a higher speed image forming can be preferably conducted.

Furthermore, in the image forming apparatus 10 (or 10*a*) according to the non-limiting embodiments, the cross-direction position corrector 44 is provided in the sheet feed route 43A to correct tilting of a transfer sheet from the transport direction while the transfer sheet is transported in the sheet feed route 43A. With such a configuration, sheet jamming caused by tilting of transfer sheet in the sheet feed route 43A can be suppressed, thereby a higher speed printing can be conducted.

Furthermore, in the image forming apparatus 10 (or 10*a*) according to the non-limiting embodiments, the first intermediate transfer belt 21 and the second intermediate transfer belt 31 (or 31*a*) do not contact each other as illustrated in FIG. 1.

If two intermediate transfer belts contact and a transfer sheet is sandwiched at such contact point to transport the transfer sheet, a line velocity difference of the two intermediate transfer belts may cause scratching of an un-fixed toner image on the transfer sheet. Such scratching can be prevented with a configuration in the image forming apparatus 10.

Furthermore, in the image forming apparatus 10 (or 10*a*) according to the non-limiting embodiments, the toner has an average circularity of from 0.90 to 0.99, and preferably from 0.93 to 0.97.

Such toner has good transferability and can produce high quality images with good dot reproducibility (i.e., without toner scattering) and thereby high quality images with high sharpness (i.e., without toner scattering) can be produced.

Furthermore, in the image forming apparatus 10 (or 10*a*) according to the non-limiting embodiments, the toner has a shape factor SF-1 of 120 to 180 and a shape factor SF-2 of 120 to 190. Such toner has good transferability and can produce high quality images with good dot reproducibility (i.e., without toner scattering).

Furthermore, in the image forming apparatus 10 (or 10*a*) according to the non-limiting embodiments, the toner has a ratio of Dv/Dn of from 1.05 to 1.30, and preferably from 1.10 to 1.25, wherein Dv/Dn is a ratio of the volume average particle diameter Dv and the number average particle diameter Dn. Such toner has good developability and can produce high quality images with good dot reproducibility.

Numerous additional modifications and variations are possible in light of the above teachings. It is therefore to be understood that within the scope of the appended claims, the disclosure of the present invention may be practiced otherwise than as specifically described herein.

This application claims priority from Japanese patent applications No. 2005-066363 filed on Mar. 9, 2005 in the Japan Patent Office, the entire contents of which are hereby incorporated by reference herein.

The invention claimed is:

1. An image forming apparatus, comprising:

a first image carrying belt configured to carry a first toner image on a surface of the first image carrying belt;

a second image carrying belt configured to carry a second toner image on a surface of the second image carrying belt;

a first transfer unit configured to transfer the first toner image from the first image carrying belt to a first face of a recording medium;

a second transfer unit configured to transfer the second toner image from the second image carrying belt to a second face of the recording medium;

a fixing unit configured to receive the recording medium directly from the second image carrying belt and to fix the first and second toner images on the respective first and second faces of the recording medium at a fixing nip of the fixing unit utilizing at least one heat roller; and a controller configured to variably control a transport speed of the heat roller and the second image carrying belt depending on a type of the recording medium when the second image carrying belt transports the recording medium from the second transfer unit to the fixing unit, wherein the controller further controls the transport speed of the heat roller to match the transport speed of the second image carrying belt.

2. The image forming apparatus according to claim 1, wherein the second transfer unit includes a transfer charger provided over the second image carrying belt without contacting the second image carrying belt.

3. The image forming apparatus according to claim 1, wherein the controller variably controls a fixing time by changing a fixing speed of the fixing unit depending on the type of the recording medium.

4. The image forming apparatus according to claim 1, wherein the second image carrying member belt includes a heat resistance belt.

5. The image forming apparatus according to claim 4, wherein the heat resistance belt includes a base layer made of polyimide.

6. The image forming apparatus according to claim 1, wherein the second image carrying member belt has a volume electric resistance value of from $10^6$ to $10^{12}$ Ω·cm.

7. The image forming apparatus according to claim 1, wherein the second image carrying member belt includes an endless type belt.

8. The image forming apparatus according to claim 1, wherein the image forming apparatus employs toner having an average circularity of from 0.90 to 0.99.

9. The image forming apparatus according to claim 1, wherein the image forming apparatus employs toner having an average circularity of from 0.93 to 0.97.

10. The image forming apparatus according to claim 1, wherein the toner has a shape factor SF-1 of from 120 to 180 and a shape factor SF-2 of from 120 to 190.

11. The image forming apparatus according to claim 1, wherein the toner has a Dv/Dn of 1.05 to 1.30, wherein the Dv/Dn is a ratio of the volume average particle diameter Dv to the number average particle diameter Dn.

12. The image forming apparatus according to claim 11, where Dv/Dn is 1.10 to 1.25.

13. An image forming apparatus, comprising:

a first image carrying belt configured to carry a first toner image on a surface of the first image carrying belt;

a second image carrying belt configured to carry a second toner image on a surface of the second image carrying belt;

a first transfer unit configured to transfer the first toner image from the first image carrying belt to a first face of a recording medium;

a second transfer unit configured to transfer the second toner image from the second image carrying belt to a second face of the recording medium;

a fixing unit configured to receive the recording medium directly from the second image carrying belt and to fix the first and second toner images on the respective first and second faces of the recording medium at a fixing nip of the fixing unit; and a controller configured to variably control a transport speed of the second image carrying belt depending on a type of the recording medium when the second image carrying belt transports the recording medium from the second transfer unit to the fixing unit, wherein the second image carrying belt has a horizontally extended portion, which extends from the second transfer unit to the fixing unit, for supporting and transporting the recording medium until the recording medium is sandwiched at the fixing nip of the fixing unit, and wherein the horizontally extended portion is set to be longer than a maximum length of the recording medium.

14. The image forming apparatus according to claim 13, wherein the controller variably controls the transport speed of the second image carrying belt, depending on the type of the recording medium, during a time when the recording medium is passed through the second transfer unit and transported on the horizontally extended portion of the second image carrying belt to the fixing unit.

15. The image forming apparatus according to claim 14, wherein the controller controls the transport speed of the second image carrying belt to one-half of a transport speed for plain paper during a time when the recording medium having a basis weight of 90 g/m$^2$ or greater is passed through the second transfer unit and transported on the horizontally extended portion of the second image carrying belt to the fixing unit.

16. An image forming apparatus, comprising:

a first image carrying belt configured to carry a first toner image on a surface of the first image carrying belt;

a second image carrying belt configured to carry a second toner image on a surface of the second image carrying belt;

a first transfer unit configured to transfer the first toner image from the first image carrying belt to a first face of a recording medium;

a second transfer unit configured to transfer the second toner image from the second image carrying belt to a second face of the recording medium;

a fixing unit configured to receive the recording medium directly from the second image carrying belt and to fix the first and second toner images on the respective first and second faces of the recording medium at a fixing nip of the fixing unit; and a controller configured to variably control a transport speed of the second image carrying belt depending on a type of the recording medium when the second image carrying belt transports the recording medium from the second transfer unit to the fixing unit, wherein the controller variably controls a fixing time by changing a fixing speed of the fixing unit depending on the type of the recording medium, and wherein the controller controls a fixing speed of the fixing unit to one-half of a fixing speed for plain paper when the recording medium having a basis weight of 90 g/m$^2$ or greater passes through the second transfer unit.

17. An image forming apparatus, comprising:

a first image carrying belt configured to carry a first toner image on a surface of the first image carrying belt;

a second image carrying belt configured to carry a second toner image on a surface of the second image carrying belt;

a first transfer unit configured to transfer the first toner image from the first image carrying belt to a first face of a recording medium;

a second transfer unit configured to transfer the second toner image from the second image carrying belt to a second face of the recording medium;

a fixing unit configured to receive the recording medium directly from the second image carrying belt and to fix the first and second toner images on the respective first and second faces of the recording medium at a fixing nip of the fixing unit; and a controller configured to variably control a transport speed of the second image carrying belt depending on a type of the recording medium when the second image carrying belt transports the recording medium from the second transfer unit to the fixing unit, wherein the first image carrying belt is disposed over the second image carrying belt in the image forming apparatus with a boundary space area between the first and second image carrying belts, and wherein the first and the second image carrying belts overlap without contacting each other when viewed in a vertical direction of the image forming apparatus, and wherein the first transfer unit and the second transfer unit transfer the first and second toner images to the respective first and second faces of the recording medium when the recording medium passes through the boundary space area between the first and second image carrying belts.

18. The image forming apparatus according to claim 17, further comprising at least one image carrying member configured to carry a toner image to be transferred to the first image carrying belt, and wherein the at least one image carrying member is provided over the first image carrying belt, in which the first image carrying belt is extended in a horizontal direction in the image forming apparatus.

19. The image forming apparatus according to claim 18, further comprising a recording medium feed unit configured to store recording medium and to feed the recording medium, and wherein the recording medium feed unit is provided in a side direction of the first image carrying belt and second image carrying belt.

20. The image forming apparatus according to claim 19, further comprising a sheet feed route configured to be used to guide the recording medium, and wherein the sheet feed route substantially extends from the recording medium feed unit to the fixing unit in a horizontally straight direction without bending in a vertical direction.

21. The image forming apparatus according to claim 20, further comprising a correcting unit, provided in the sheet feed route, and configured to correct a tilting of the recording medium from a transport direction of the recording medium when the recording medium is transported in the sheet feed route toward the first transfer unit.

22. An image forming apparatus, comprising:

a first image carrying belt configured to carry a first toner image on a surface of the first image carrying belt;

a second image carrying belt configured to carry a second toner image on a surface of the second image carrying belt;

a first transfer unit configured to transfer the first toner image from the first image carrying belt to a first face of a recording medium;

a second transfer unit configured to transfer the second toner image from the second image carrying belt to a second face of the recording medium;

means for receiving the recording medium directly from the second image carrying belt and for fixing the first and second toner images on the respective first and second faces of the recording medium at a fixing nip utilizing at least one heat roller; and means for variably controlling a transport speed of the heat roller and the second image carrying belt depending on a type of the recording medium when the second image carrying belt transports the recording medium from the second transfer unit to the means for receiving, wherein the means for variably controlling further controls the transport speed of the heat roller to match the transport speed of the second image carrying belt.

23. A method of producing an image on a recording medium with an image forming apparatus, comprising:

forming a first toner image on a surface of the first image carrying belt;

forming a second toner image on a surface of the second image carrying belt;

transferring the first toner image from the first image carrying belt to a first face of a recording medium;

transferring the second toner image from the second image carrying belt to a second face of the recording medium;

transporting the recording medium to a fixing unit directly from the second image carrying belt; and fixing the first and second toner image on the respective first and second face of the recording medium in the fixing unit utilizing at least one heat roller;

wherein a transport speed of the heat roller and the second image carrying belt is variably controlled depending on a type of the recording medium when the recording medium is transported on the second image carrying belt to the fixing unit, wherein the transport speed of the heat roller is further controlled to match the transport speed of the second image carrying belt.

* * * * *